US006736065B2

(12) United States Patent
Naniwa et al.

(10) Patent No.: US 6,736,065 B2
(45) Date of Patent: May 18, 2004

(54) PLATE-MOUNTING MEMBER, FOR MOUNTING AND POSITIONING FLEXIBLE PRINTING PLATE IN PLATE CLAMPING MECHANISM

(75) Inventors: Mutsumi Naniwa, Shizuoka (JP); Chikashi Oishi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/788,619

(22) Filed: Feb. 21, 2001

(65) Prior Publication Data

US 2001/0023648 A1 Sep. 27, 2001

(30) Foreign Application Priority Data

Feb. 21, 2000 (JP) ..... P. 2000-043031
Mar. 14, 2000 (JP) ..... P. 2000-070598

(51) Int. Cl.[7] ..... B41F 27/12

(52) U.S. Cl. ..... 101/415.1; 101/378; 101/382.1; 101/384

(58) Field of Search ..... 101/415.1, 485, 101/486, 378, 382.1, 383, 384, 385, 389, 477

(56) References Cited

U.S. PATENT DOCUMENTS 1,788,662 A * 1/1931 Creed ..... 101/128.1
2,553,856 A * 5/1951 Janke ..... 101/415.1
3,406,629 A * 10/1968 Hoexter ..... 101/415.1
3,537,395 A * 11/1970 Prince et al. ..... 101/378
5,555,811 A 9/1996 Ruckmann et al.
5,562,039 A * 10/1996 Fox et al. ..... 101/378
6,474,236 B1 * 11/2002 Naniwa et al. ..... 101/477

FOREIGN PATENT DOCUMENTS

EP 0 950 925 A2 10/1999
GB 840 745 7/1960

* cited by examiner

*Primary Examiner*—Leslie J. Evanisko
(74) *Attorney, Agent, or Firm*—Sughrue Mion, PLLC

(57) ABSTRACT

A plate-mounting member to be attached to a plate front end of a flexible plate in order to mount said flexible plate having a plurality of fixing holes onto a plate cylinder including a plate front end clamp mechanism having upper and lower teeth and at least two positioning pins disposed between upper and lower teeth, said plate-mounting member comprising a base and a plurality of fixing pins disposed on said base to be respectively inserted into said plurality of fixing holes formed in said plate front end, wherein said base is to be attached to said positioning pins disposed in said plate front end clamp mechanism to thereby position said plate front end. Also disclosed are method and apparatus for mounting a flexible printing plate.

5 Claims, 19 Drawing Sheets

PLATE-MOUNTING MEMBER, FOR MOUNTING AND POSITIONING FLEXIBLE PRINTING PLATE IN PLATE CLAMPING MECHANISM

FIELD OF THE INVENTION

The present invention relates to a plate-mounting member which is used to mount a plate onto a plate cylinder disposed in a printing apparatus or a plate-making apparatus. The present invention also relates to method and apparatus for mounting a printing plate, especially, a digitally made flexible printing plate, onto a plate cylinder of a printing apparatus.

DESCRIPTION OF THE RELATED ART

In a lithographic printing apparatus, generally, a printing plate is wound around and fixed to a plate cylinder and, in this state, printing is executed.

However, a lithographic printing plate (in the present specification, this is referred to as a flexible printing plate), which uses as a support member a member formed of other material than metal inexpensive and easy to handle (for example, a plastic film or paper), has a weak point in dimensional stability. For example, the flexible printing plate can be deformed depending on the way of handling of the flexible printing plate when it is mounted or due to a frictional force between a rubber cylinder and itself during printing, which can degrade the printing dimension as well as the printing position accuracy with respect to paper.

Therefore, use of the flexible printing plate of the above type, conventionally, is limited to a simple printing which prints a relatively small number of printings and does not require the high matching accuracy of the printings; that is, such flexible printing plate has not been employed in a high-quality printing using multiple colors and requiring great delicacy or in a full-dress printing using a large-scale printing machine.

Here, description will be given in detail of the above-mentioned deformation that is caused depending on the way of handling of the flexible printing plate when it is mounted. In FIGS. 19 and 20, there is shown a typical printing plate-mounting apparatus. Specifically, FIG. 20 is a view of the printing plate-mounting apparatus when it is viewed from the direction of the arrow mark X shown in FIG. 19; and, FIG. 19 is a section view taken along the line Y—Y shown in FIG. 20.

As shown in FIG. 19, the plate cylinder 61 of the printing machine is structured such that a portion of a cylinder is cut away along the axial direction of the cylinder and, in a substantially flat surface (which is hereinafter referred to as a flat surface portion 61*a*, which is the cut face of the cutaway portion of the cylinder), there is formed a groove portion 65. And, within the groove portion 65, there are disposed a plate front end clamp mechanism 62 for holding the front end or leading end of a printing plate 70, and a plate rear end clamp mechanism 63 for holding the rear end or trailing end of the printing plate 70. The clamp mechanisms 62 and 63 respectively include lower teeth 62*b* and 63*b* (the upper surfaces of which are substantially flush with the flat surface portions 61*a*), and upper teeth 62*a* and 63*a* which are rotatably supported by their respective lower teeth and are capable of holding the plate front end or rear end between the upper surfaces of their respective lower teeth and themselves. Further, there is disposed a position adjusting mechanism (not shown) which is capable of adjusting the positions of the plate front end clamp mechanism 62 and plate rear end clamp mechanism 63 in the back-and-forth direction, in the right-and-left direction and in the oblique direction on the bottom surface of the groove portion 65.

Between the two flat surface portions 61*a* and curved surface portion 61*b* of the plate cylinder 61, there are formed top portions 61*c* respectively. Although not shown, there is known another type of plate cylinder in which there are formed top portions between the upper surfaces of the lower teeth of the clamp mechanisms, instead of the flat surface portions, and the curved portion of the plate cylinder.

Normally, the portions of the plate cylinder 61, where the two flat surface portions 61*a* and curved surface portion 61*b* cross each other, are each rounded to thereby provide a curved surface having a radius of 5–30 mm. It should be noted here that, in the present specification, such curved surface portions are also referred to as top portions.

And, as shown in FIG. 20, two positioning pins 64 are respectively provided on and projected from the upper surface of the lower tooth 62*b* of the plate front end clamp mechanism; specifically, at two positions of the lower tooth 62*b* upper surface which are spaced from each other in the axial direction of the plate cylinder 61. At the positions of the upper surface 62 of the plate front end clamp mechanism that correspond to the positioning pins 64, there are formed notches 66 respectively. Also, in the front end portion 70*a* of the printing plate 70 which is shown by a two-dot chained line in FIG. 20; specifically, at the positions of the front end portion 70*a* that correspond to the positioning pins 64, there are also formed two notches 71 respectively.

Recently, as printings have been turned into small lots and diversified, there has increased the need for a plate (which, in the present specification, is referred to as a flexible plate comprising a support member formed of material which is inexpensive and easy to handle (for example, plastic film, paper) other than metal, and a photosensitive layer disposed on such support member. However, since such plate is high in flexibility, there arise several problems when it is mounted on the plate cylinder.

For example, there is generally known a case where the flexible printing plate 70 is mounted onto the plate cylinder 61 using the printing plate-mounting apparatus shown in FIGS. 7 and 8. Specifically, in this case, when, while holding the plate rear end 70*b*, an operator pushes the plate front end 70*a* of the printing plate between the upper tooth 62*a* and lower tooth 62*b* of the plate front end clamp mechanism to thereby bring the plate front end 70*a* into contact with two positioning pins 64, there is a fear that the plate front end 70*a* can be deformed and can be fixed in such deformed state. That is, in a plate cylinder capable of mounting thereon a printing plate of a half-kiku size or more, the distance between the two positioning pins 64 in the plate cylinder 61 is fairly wide; and, therefore, when mounting the printing plate 70 onto the plate cylinder 61, in case where the operator overpushes the printing plate 70 even slightly, the printing plate 70 can be deformed in such a manner that the plate front end 70*a* is projected in the pushing direction from between the two positioning pins 64. However, in case where the operator pushes the printing plate 70 insufficiently in order to avoid such deformation of the printing plate 70, the printing plate 70 cannot be positioned accurately.

As described above, the mountability of the flexible plate onto the plate cylinder is poor and thus it is difficult to always mount the flexible plate onto the plate cylinder in a constant state. Therefore, there are necessary a plurality of plate cylinders and thus, in case where the flexible plate is used in a multicolor printing (for example, four-color printing) which requires strict matching between the plate cylinders, mismatching can occur.

Also, as shown in FIG. 19, in the vicinity of the top portions 61*c* respectively formed between the flat surface portions 61*a* and curved portion 61*b* of the plate cylinder 61, the flexible printing plate 70 does not easily stick to the outer peripheral surface of the plate cylinder 61 but the flexible printing plate 70 tends to float up from the outer peripheral surface of the plate cylinder 61.

In order to prevent such flotation of the printing plate 70, an operator, while pulling strongly the plate rear end of the printing plate 70 with the plate front end thereof held by the plate front end clamp mechanism 62, rotates the plate cylinder to thereby wind the printing plate 70 onto the plate cylinder. In this case, however, the strongly pulled portion of the plate rear end of the flexible printing plate 70 is stretched loosely.

After the printing plate is wound onto the plate cylinder while pulling the plate rear end in the above-mentioned manner, the plate rear end of the printing plate is pushed into between the upper and lower teeth of the plate rear end clamp mechanism, the upper tooth is rotated to thereby fix the plate rear end, and, using a tension apply mechanism (not shown), the plate rear end clamp mechanism is moved in a direction where a tensile force is applied to the printing plate, thereby bringing the printing plate into close contact with the peripheral surface of the plate cylinder, which completes the mounting of the printing plate onto the plate cylinder.

However, in an ordinary conventional plate-mounting apparatus, the tension apply mechanism for contacting the flexible printing plate with the peripheral surface of the plate cylinder closely is designed in combination with a printing plate having a support member formed of metal such as aluminum; and, therefore, in the case of the flexible printing plate, it is stretched more than necessary.

Also, in case where the tension apply mechanism is designed such that it can apply a lower tensile force according to the flexible printing plate, the tensile force applied is too weak to closely contact the printing plate with the plate cylinder. Even if the printing plate can be mounted onto the plate cylinder in such a manner that the printing plate is prevented from floating up from the plate cylinder, in the case of such weak tensile force, the printing plate deviates in position due to a frictional force which is produced between a rubber cylinder and itself in printing.

Recently, in a lithographic printing method, due to the enhancement in the latest digital picture drawing technology as well as due to the need for enhancement in the efficiency of processing, there have been proposed a large number of systems for drawing digital image information directly on a printing plate. This is a technology which is referred to as CTP (Computer-to-plate) or DDPP (Digital Direct Printing Plate).

This technology is advantageous over a conventional plate making method (which provides close-contact exposure with a lith film superimposed on top of a printing plate) in that it can provide better image position accuracy with respect to a flexible printing plate and better matching accuracy in a multicolor printing.

Of course, there is also proposed a digital reprographic (plate making) system using a flexible printing plate; and, because it is inexpensive, there exists the need for a multicolor printing using this system. However, since the flexible printing plate has the above-mentioned problems, it cannot make the best use of its advantage that it can provide excellent image position accuracy in the digital reprography; and, therefore, in a multicolor printing, it has not been able to realize matching accuracy equivalent to that of the printing plate having a metal support member.

SUMMARY OF THE INVENTION

The present invention aims at eliminating the above-mentioned drawbacks.

Accordingly, an object of the invention is to provide a flexible plate-mounting member which is capable of mounting a flexible plate onto a plate cylinder positively and easily.

Another object of the invention to provide flexible printing plate-mounting method and apparatus which is capable of mounting a digitally-made flexible printing plate easily without deforming the same, allows the flexible printing plate to be applied to a conventional printing machine with slight improvements, and allows the flexible printing plate to provide dimensional stability equivalent to that of a metal support member printing plate as well as matching accuracy in a multicolor printing.

Other objects and effects of the present invention will become apparent from the following description.

In a first aspect, the present invention relates to the following items (1-1) to (1-3).

(1-1) A plate-mounting member to be attached to a plate front end of a flexible plate in order to mount said flexible plate having a plurality of fixing holes onto a plate cylinder including a plate front end clamp mechanism having upper and lower teeth and at least two positioning pins disposed between upper and lower teeth, said plate-mounting member comprising a base and a plurality of fixing pins disposed on said base to be respectively inserted into said plurality of fixing holes formed in said plate front end, wherein said base is to be attached to said positioning pins disposed in said plate front end clamp mechanism to thereby position said plate front end.

(1-2) The plate-mounting member according to item (1-1) above, wherein said plurality of fixing pins are disposed on said base along the width direction of said plate and the distance between adjacent fixing pins is not more than 400 mm.

(1-3) The plate-mounting member according to item (1-1) or (1-2) above, wherein deformation preventive notches are formed in the portions of said base that are to be held by said upper and lower teeth.

In a second aspect, the present invention relates to the following items (2-1) to (2-13).

(2-1) A flexible printing plate-mounting method for mounting a flexible printing plate having three or more notches formed in a plate front end thereof onto a plate cylinder, comprising the steps of:

providing a flexible printing plate-mounting apparatus comprising:

a plate front end positioning and fixing mechanism comprising: a plate front end clamp mechanism having upper teeth and lower teeth for fixing the plate front end of said printing plate to said plate cylinder; and at least three positioning pins respectively disposed in said plate front end clamp mechanism in such a manner that they are respectively opposed to said notches of said printing plate;

a printing plate pressure mechanism for pressing said printing plate against said plate cylinder;

a plate rear end fixing mechanism for fixing the plate rear end of said printing plate to said plate cylinder; and a packing sheet which is wound and fixed to said plate cylinder and has a function of preventing positional deviation of said printing plate;

positioning and fixing said plate front end to said plate cylinder by inserting the plate front end of said printing plate into between said upper and lower teeth of said plate front end clamp mechanism to contact the inner peripheral surfaces of said notches of said plate front end with said at least three positioning pins;

winding said printing plate onto said plate cylinder by rotating said plate cylinder with said plate rear end set free, while said printing plate pressure mechanism presses said printing plate against the entire outer peripheral surface of said plate cylinder including top portions thereof using a pressure member; and pressing and fixing said plate rear end of said printing plate in a radial direction of said plate cylinder using said plate rear end fixing mechanism after completion of said winding;

whereby stretching of said flexible printing plate in its maximum printing length in the rotational direction of said plate cylinder during said printing plate-mounting operation is suppressed to 100 $\mu$m or less.

(2-2) A flexible printing plate-mounting method for mounting a flexible printing plate having at least three fixing holes formed in a plate front end thereof onto a plate cylinder, comprising the steps of:

providing a flexible printing plate-mounting apparatus comprising:

a plate front end positioning and fixing mechanism comprising: a plate front end clamp mechanism having upper teeth and lower teeth for fixing the plate front end of said printing plate to said plate cylinder; positioning pins disposed in said plate front end clamp mechanism; and a pin contact member which has higher rigidity than said printing plate, is to be attached to said positioning pin and has at least three fixing pins for fixing said printing plate;

a printing plate pressure mechanism for pressing said printing plate against said plate cylinder;

a plate rear end fixing mechanism for fixing the plate rear end of said printing plate to said plate cylinder; and a packing sheet which is wound and fixed to said plate cylinder and has a function of preventing positional deviation of said printing plate;

positioning and fixing said plate front end to said plate cylinder by allowing said fixing holes of said printing plate to be inserted with said fixing pins of said pin contact member between said upper and lower teeth of said plate front end clamp mechanism;

winding said printing plate onto said plate cylinder by rotating said plate cylinder with said plate rear end set free, while said printing plate pressure mechanism presses said printing plate against the entire outer peripheral surface of said plate cylinder including top portions thereof using a pressure member; and pressing and fixing said plate rear end of said printing plate in a radial direction of said plate cylinder using said plate rear end fixing mechanism after completion of said winding;

whereby stretching of said flexible printing plate in its maximum printing length in the rotational direction of said plate cylinder during said printing plate-mounting operation is suppressed to 100 $\mu$m or less.

(2-3) A flexible printing plate-mounting method for mounting a flexible printing plate having at least three fixing holes formed in a plate front end thereof onto a plate cylinder, comprising the steps of:

providing a flexible printing plate-mounting apparatus comprising:

a plate front end positioning and fixing mechanism comprising: a plate front end clamp mechanism having upper teeth and lower teeth for fixing the plate front end of said printing plate to said plate cylinder; and a positioning pin disposed in said plate front end clamp mechanism;

a printing plate pressure mechanism for pressing said printing plate against said plate cylinder;

a plate rear end fixing mechanism for fixing the plate rear end of said printing plate to said plate cylinder;

a packing sheet which is wound and fixed to said plate cylinder and has a function of preventing positional deviation of said printing plate; and a pin contact member which has higher rigidity than said printing plate and includes at least three fixing pins for fixing said printing plate;

fixing said printing plate on said pin contact member by allowing said fixing holes of said printing plate to be inserted into said fixing pins of said pin contact members respectively;

fixing and positioning said printing plate onto said plate cylinder by fixing a leading end of said pin contact member to said positioning pin between said upper and lower teeth of said plate front end clamp mechanism;

winding said printing plate onto said plate cylinder by rotating said plate cylinder with said plate rear end set free, while said printing plate pressure mechanism presses said printing plate against the entire outer peripheral surface of said plate cylinder including top portions thereof using a pressure member; and pressing and fixing said plate rear end of said printing plate in a radial direction of said plate cylinder using said plate rear end fixing mechanism after completion of said winding;

whereby stretching of said flexible printing plate in, its maximum printing length in the rotational direction of said plate cylinder during said printing plate-mounting operation is suppressed to 100 $\mu$m or less.

(2-4) The flexible printing plate-mounting method according to any one of items (2-1) to (2-3) above, wherein said packing sheet has at least one roughened surface, and said packing sheet is wound and fixed onto said plate cylinder in such a manner that said roughened surface side becomes an outer surface side.

(2-5) The flexible printing plate-mounting method according to any one of items (2-1) to (2-3) above, wherein said packing sheet has at least one sticky surface, and said packing sheet is wound and fixed onto said plate cylinder in such a manner that said sticky surface side becomes an outer surface side.

(2-6) The flexible printing plate-mounting method according to any one of items (2-1) to (2-5) above, wherein said flexible printing plate-mounting apparatus further comprises a guide member for holding said printing plate, wherein said guide member holds said printing plate, before and during mounting said printing plate onto said plate cylinder, in such a manner that the plate rear end thereof is set free.

(2-7) A flexible printing plate-mounting apparatus for mounting a flexible printing plate having three or more notches formed in a plate front end thereof onto a plate cylinder, said flexible printing plate-mounting apparatus comprising:

a plate front end positioning and fixing mechanism comprising: a plate front end clamp mechanism having upper teeth and lower teeth for fixing the plate front end of said printing plate to said plate cylinder; and at least three positioning pins respectively disposed in said plate front end clamp mechanism in such a manner that they are respectively opposed to said notches of said printing plate;

a printing plate pressure mechanism for pressing said printing plate against said plate cylinder;

a plate rear end fixing mechanism for fixing the plate rear end of said printing plate to said plate cylinder; and a packing sheet which is wound and fixed to said plate cylinder and has a function of preventing positional deviation of said printing plate.

(2-8) A flexible printing plate-mounting apparatus for mounting a flexible printing plate onto a plate cylinder, said flexible printing plate-mounting apparatus comprising:

a plate front end positioning and fixing mechanism comprising: a plate front end clamp mechanism having upper teeth and lower teeth for fixing the plate front end of said printing plate to said plate cylinder; positioning pins disposed in said plate front end clamp mechanism; and a pin contact member which has higher rigidity than said printing plate, is to be attached to said positioning pin and has at least three fixing pins for fixing said printing plate;

a printing plate pressure mechanism for pressing said printing plate against said plate cylinder;

a plate rear end fixing mechanism for fixing the plate rear end of said printing plate to said plate cylinder; and a packing sheet which is wound and fixed to said plate cylinder and has a function of preventing positional deviation of said printing plate.

(2-9) A flexible printing plate-mounting apparatus for mounting a flexible printing plate onto a plate cylinder, said flexible printing plate-mounting apparatus comprising:

a plate front end positioning and fixing mechanism comprising: a plate front end clamp mechanism having upper teeth and lower teeth for fixing the plate front end of said printing plate to said plate cylinder; and a positioning pin disposed in said plate front end clamp mechanism;

a printing plate pressure mechanism for pressing said printing plate against said plate cylinder;

a plate rear end fixing mechanism for fixing the plate rear end of said printing plate to said plate cylinder;

a packing sheet which is wound and fixed to said plate cylinder and has a function of preventing positional deviation of said printing plate; and a pin contact member which has higher rigidity than said printing plate and includes at least three fixing pins for fixing said printing plate.

(2-10) The flexible printing plate-mounting apparatus according to any one of items (2-7) to (2-9) above, wherein said packing sheet has at least one roughened surface, and said packing sheet is wound and fixed onto said plate cylinder in such a manner that said roughened surface side becomes an outer surface side.

(2-11) The flexible printing plate-mounting apparatus according to any one of items (2-7) to (2-9) above, wherein said packing sheet has at least one sticky surface, and said packing sheet is wound and fixed onto said plate cylinder in such a manner that said sticky surface side becomes an outer surface side.

(2-12) The flexible printing plate-mounting apparatus according to any one of items (2-7) to (2-11), further comprising a guide member for holding said printing plate, before and during mounting said printing plate onto said plate cylinder, in such a manner that the plate rear end thereof is set free.

(2-13) The flexible printing plate-mounting apparatus according to any one of items (2-7) to (2-12), further comprising:

a rotating member for rotating said plate cylinder when mounting said printing plate onto said plate cylinder;

a detector for detecting the rotational position of said plate cylinder;

a rotation controller for controlling the rotation and stopping of said plate cylinder rotating member at given positions in accordance with signals from said rotational position detector;

a driving member for driving said pressure member so as to be into contact with or separated from said plate cylinder; and a controller for controlling said driving member at given positions in accordance with signals from said rotational position detector.

DETAILED DESCRIPTION OF THE INVENTION

Figure 1:
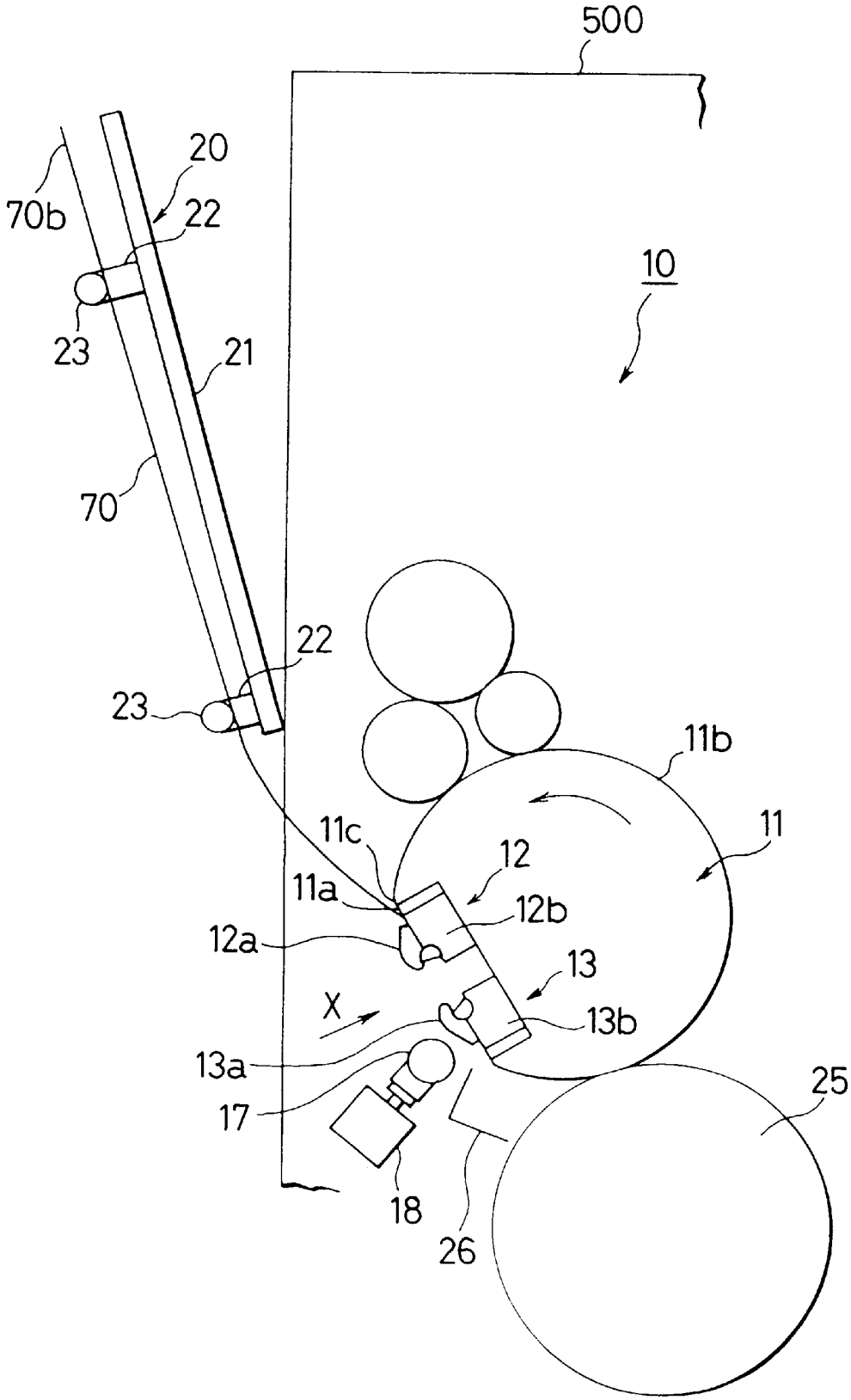
FIG. 1 is a schematic view of embodiment 2-1 of the flexible printing plate-mounting apparatus according to the invention.

The first aspect of the present invention is described in more detail below.

As the flexible plate, there can be used a support member which is formed of a plastic film or paper other than metal, and a support member which is a combination of such plastic film and paper support members. In more detail, there can be used a support member comprising a plastic film which is formed of polyester, polyethylene terephthalate, polyethylene naphthalate, or polycarbonate; and, a support member comprising a composite sheet which can be produced in such a manner that a plastic sheet formed of polyethylene or polypropylene is laminated on paper. Although it is suitable that the thickness of the support member is set in the range of 75–500 $\mu$m, the optimum value of the support member thickness varies according to the kinds of the support members used and printing conditions. Generally, most preferably, the thickness of the support member may be set in the range of 100–400 $\mu$m.

The positioning pin disposed in the plate front end clamp mechanism includes a pin which is provided on and projected from the upper surface of the lower tooth of the plate front end clamp mechanism toward the upper tooth thereof, a pin which is provided on and projected from the lower surface of the upper tooth of the plate front end clamp mechanism toward the lower tooth thereof, and a pin which is provided on and projected from the plate cylinder and is arranged in the vicinity of the plate front end clamp mechanism.

The material of the base of the plate-mounting member, preferably, may be higher in rigidity than the flexible plate; for example, metal can be used. The fixing pin may be a pin which is formed integral with the base, or a pin which is produced separately and mounted onto the base afterward.

By using the above-structured plate-mounting member, the front end of the flexible plate can be protected by the plate-mounting member to thereby eliminate the possibility that the plate front end can be projected from between the two positioning pins. Therefore, the mountability of the flexible plate onto the plate cylinder can be enhanced remarkably. This not only can reduce the burden of the operator but also can prevent the above-mentioned mismatching to thereby allow the flexible plate to be used in a multicolor printing as well.

Also, in the above structure, in case where the plurality of fixing pins are disposed on the base of the plate-mounting member along the width direction of the plate and the distance between the fixing pins is equal to or less than 400 mm, the plate can be prevented from being deformed in such a manner that the plate front end is projected from between the two positioning pins. More preferably, in case where the distance between the fixing pins is equal to or less than 270 mm, the plate can be prevented against deformation more positively. The distance between the fixing pins may not be constant, provided it exists in the above-mentioned range.

Also, in case where deformation preventive notches are respectively formed at the positions of the base which are held by the upper and lower teeth, the durability of the plate-mounting member can be enhanced.

Now, description will be given below in detail of preferred embodiments of the plate-mounting member according to the first aspect of the invention with reference to the accompanying drawings. The parts that have been previously described herein are given the same designations or corresponding designations in the drawings and thus the description thereof is simplified or omitted here.

Figure 21:
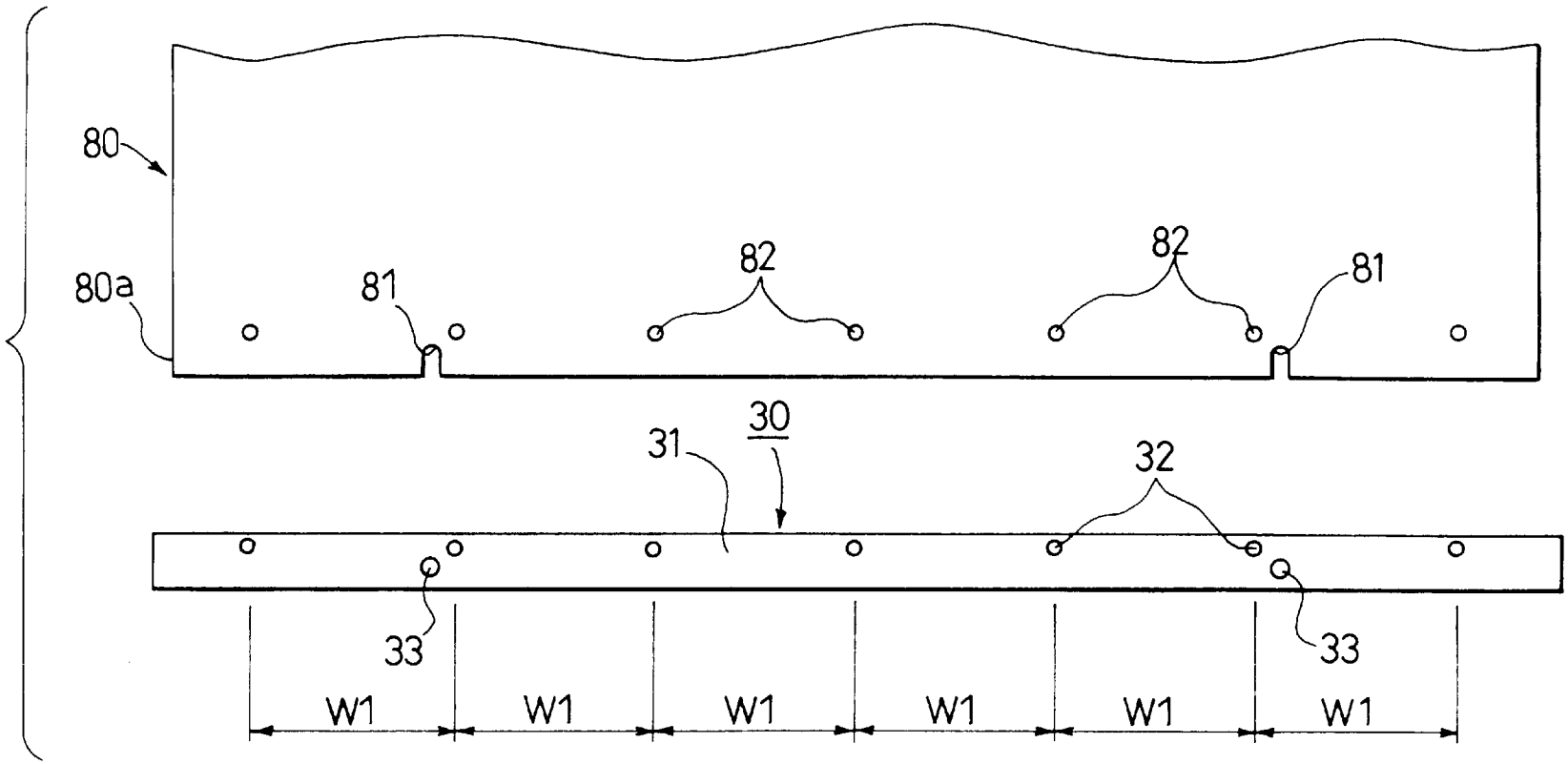
FIG. 21 is a plan view of embodiment 1-1 of the plate-mounting member according to the invention.

In FIG. 21, there are shown a plate-mounting member 30 which provides embodiment 1-1 according to the invention, and a polyester-made printing plate 80 used as a flexible plate onto which the plate-mounting member 30 is to be mounted.

Figure 20:
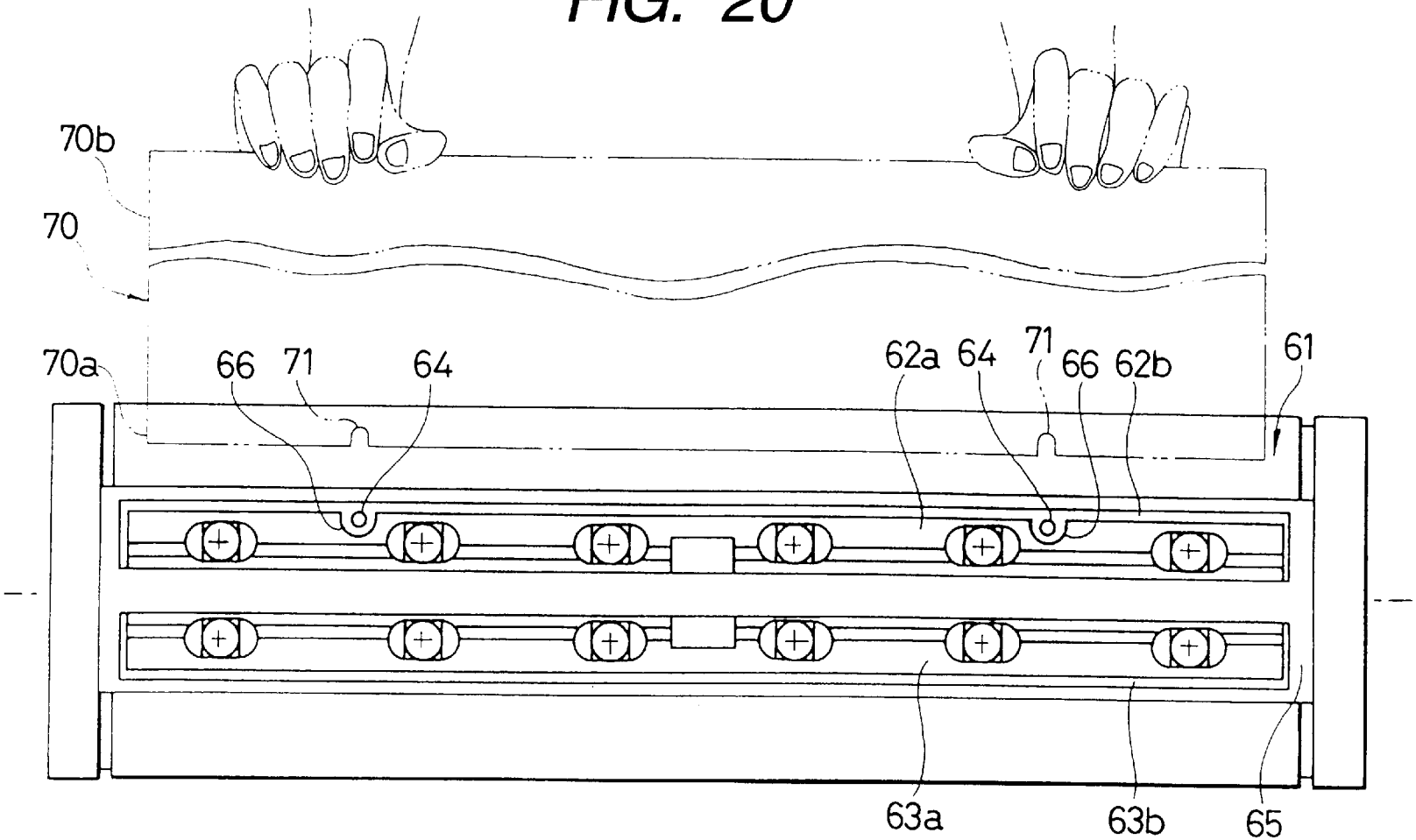
PRIOR ART FIG. 20

In the plate front end 80*a* of the printing plate 80, more specifically, at the two portions of the plate front end 80*a* that respectively correspond to the two positioning pins 64 shown in FIG. 20, there are formed two notches 81 each having a substantially U-shaped peripheral edge. Also, in the plate front end 80*a*, there are opened up a plurality of (in this embodiment, 7) fixing holes 82 which are spaced from one another by a given distance W1 in the width direction of the printing plate 80 (the direction along the axial direction of the plate cylinder; in FIG. 21, in the right and left direction). The fixing holes 82 can be formed at the same time when the notches 81 are formed.

The plate-mounting member 30 is made of steel, stainless steel, other alloy steel, or brass. The plate-mounting member 30 includes a band-shaped (a rectangular-shaped) base 31 having a length equal to or greater than the width of the printing plate 80. In the portions of the base 31 that respectively correspond to the two positioning pins 64, there are formed circular-shaped insertion holes 33. Also, on the base 31, there are projectingly provided a plurality of (in this embodiment, 7) fixing pins 32 which are spaced from one another by a given distance in the longitudinal direction of the base 31. The plurality of fixing pins 32 are disposed on a straight line extending along the width direction of the printing plate 80, that is, along the longitudinal direction of the plate-mounting member 30. The size of the fixing pin 32 is not limited but, for example, the fixing pin 32 can be set such that it has a diameter of 6 mm and a height of 4 mm or so. The transverse-direction width of the base 31 is also not limited but the width may only be set such that the base 31 can be prevented from touching the top portions of the plate cylinder when it is mounted onto the plate cylinder.

Figure 22:
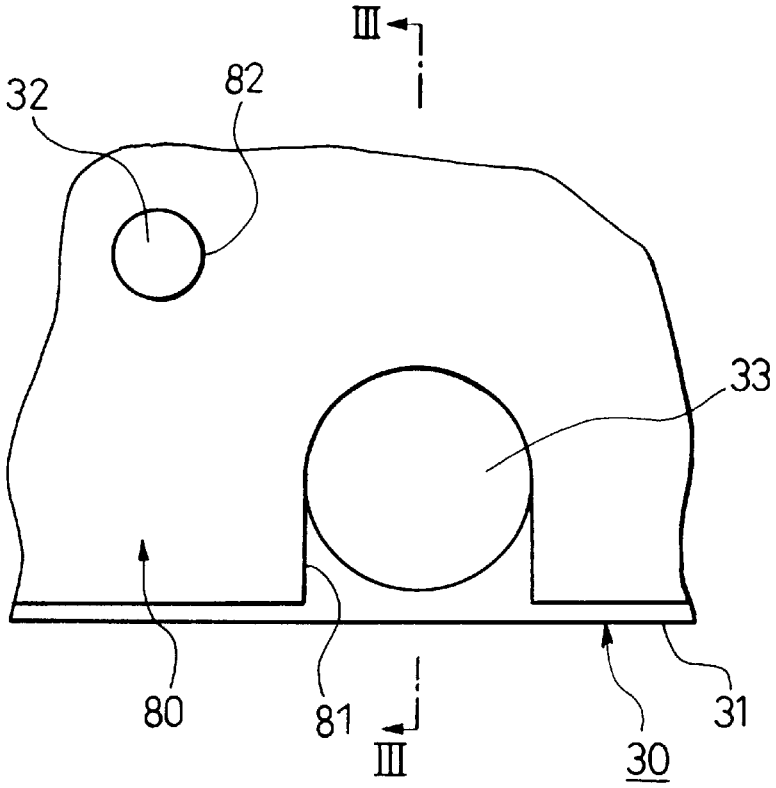
FIG. 22 is an enlarged view of the main portions of embodiment 1-1 shown in FIG. 21.

Now, FIG. 22 shows an enlarged view of the neighboring portion of each notch 81 of the printing plate 80 shown in FIG. 21 when the plate-mounting member 30 is mounted onto the plate front end 80*a* of the printing plate 80. As shown in FIG. 22, by inserting the fixing pin 32 of the plate-mounting member 30 into the fixing hole 82 of the printing plate 80, the plate-mounting member 30 can be fixed to the printing plate 80. Here, the plate-mounting member 30 and printing plate 80 are set such that a portion of the peripheral edge of the circular-shaped insertion hole 33 of the plate-mounting member 30 can be matched to the curved portion of the substantially U-shaped peripheral edge of the notch 81 of the printing plate 80.

When mounting the printing plate 80 onto the plate cylinder 61 shown in FIG. 20, with the insertion holes 33 of the plate-mounting member 30 respectively inserted into their associated positioning pins 64 of the plate front end clamp mechanism 62, the plate front end 80*a* of the printing plate 80 is fixed to the plate-mounting member 30.

Figure 23:
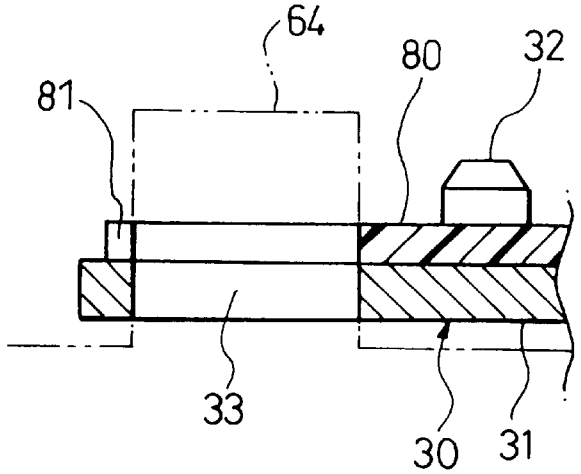
FIG. 23 is a section view taken along the line III—III shown in FIG. 22.

Now, FIG. 23 is a section view taken along the line III—III shown in FIG. 22. As shown by a two-dot chained line in FIG. 23, when the positioning pins 64 of the plate cylinder 61 are inserted into the insertion holes of the plate-mounting member 30, the inner peripheral surface of the notches 81 of the printing plate 80 are contacted with the positioning pins 64 together with the inner peripheral surfaces of the insertion holes 33 of the plate-mounting member 30.

With use of the above-structured plate-mounting member 30, the plate front end 80*a* of the printing plate 80 can be protected by the plate-mounting member 30 as well as the printing plate 80 can be prevented from being deformed in such a manner that the plate front end 80*a* thereof is projected from between the two positioning pins 64. Therefore, not only the mountability of the flexible printing plate 80 onto the plate cylinder can be enhanced remarkably to thereby reduce the burden of the operator, but also the above-mentioned mismatching can be prevented to thereby allow the flexible printing plate 80 to be used in a multicolor printing as well.

Since a conventionally used plate cylinder can be used as it is, the facility cost cannot be expensive.

Figure 24:
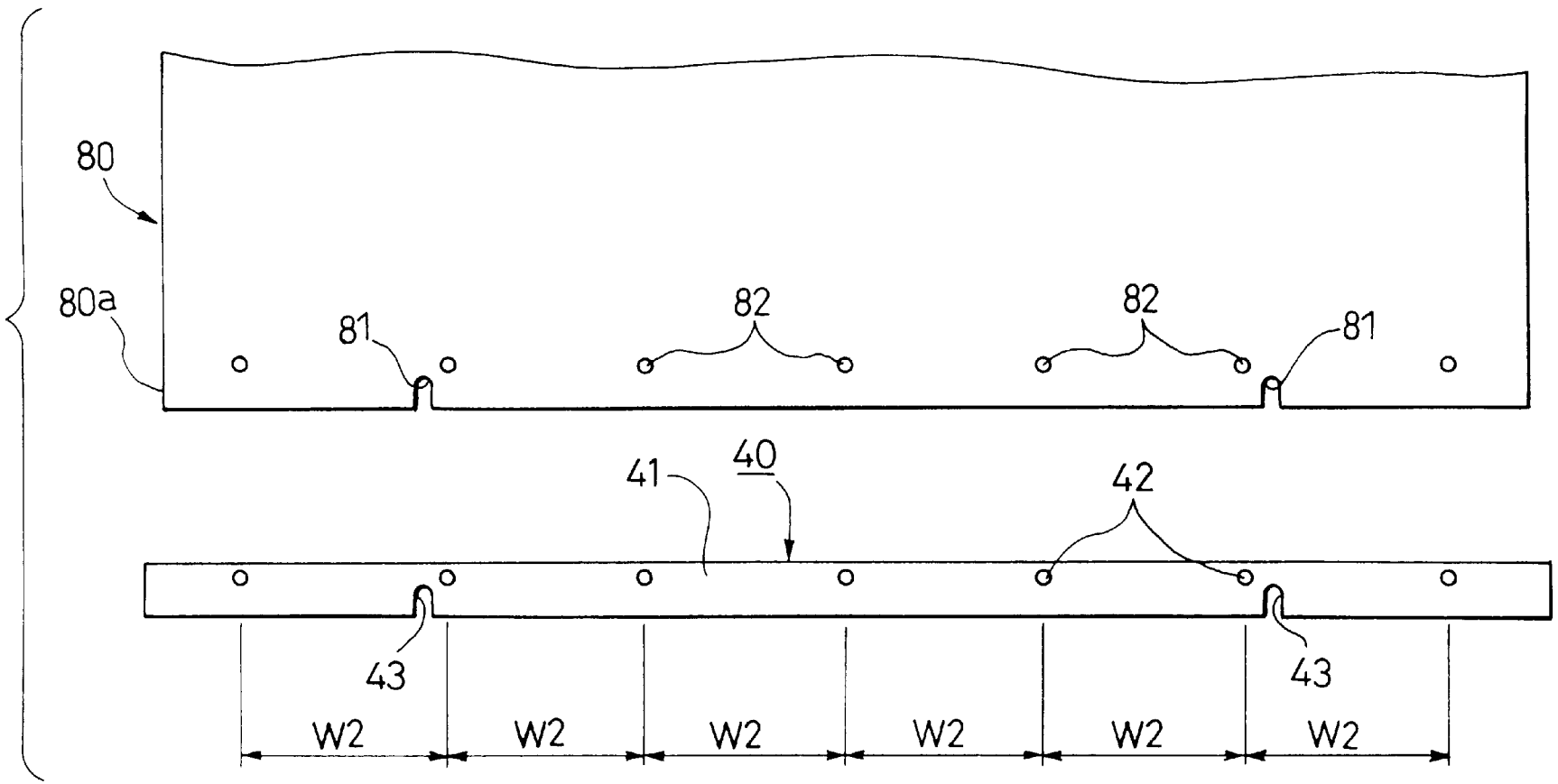
FIG. 24 is a plan view of embodiment 1-2 of the plate-mounting member according to the invention.

Now, FIG. 24 shows a plate-mounting member 40, which provides embodiment 1-2 according to the invention, and a printing plate 80. The plate-mounting member 40 includes a base 41 having a length equal to or greater than the width of the printing plate 80. In the portions of the base 41 that respectively correspond to the two positioning pins 64 of the plate cylinder 61 shown in FIG. 20, there are formed two notches 43 each having a substantially U-shaped peripheral edge. Also, on the base 41, there are projectingly provided a plurality of (in this embodiment, 7) fixing pins 42 in such a manner that they are spaced from one another by a given distance W2 (in this embodiment, 120 mm) in the longitudinal direction of the base 41.

Figure 25:
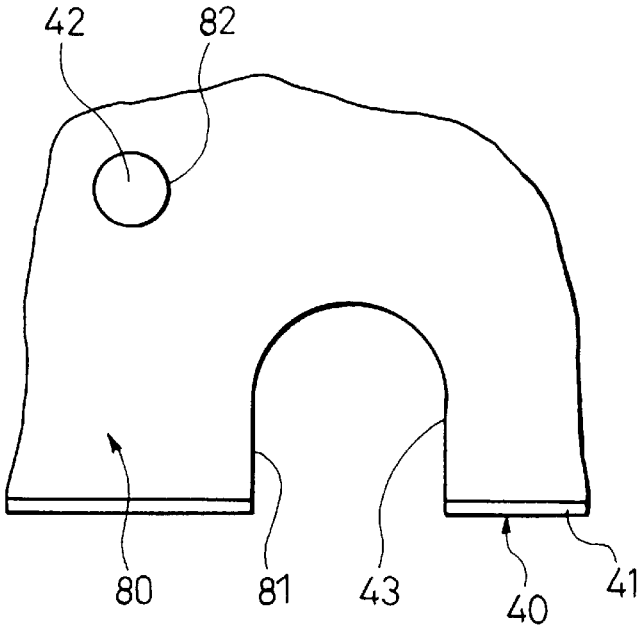
FIG. 25 is an enlarged view of the main portions of embodiment 1-2 shown in FIG. 24.

Now, FIG. 25 shows an enlarged view of the neighboring portion of each notch 81 of the printing plate 80 when the plate-mounting member 40 is mounted onto the plate front end 80*a* of the printing plate 80 shown in FIG. 24. As shown in FIG. 25, by inserting the fixing pins 42 of the plate-mounting member 40 into their associated fixing holes 82 of the printing plate 80, the plate-mounting member 40 can be fixed to the printing plate 80. Here, the plate-mounting member 40 and printing plate 80 are set such that the peripheral edges of the notches 43 of the plate-mounting member 40 can be matched to the peripheral edges of the notches 81 of the printing plate 80.

With use of the above-structured plate-mounting member 40, not only the plate front end 80*a* of the flexible printing plate 80 can be protected by the plate-mounting member 40 but also the printing plate 80 can be prevented from being deformed in such a manner that the plate front end 80*a* thereof is projected from between the two positioning pins 64.

Also, according to the present plate-mounting member 40, when the plate front end 80*a* of the printing plate 80 is fixed to the plate front end clamp mechanism after the plate-mounting member 40 is fixed to the plate front end 80*a*, the plate-mounting member 40 can be inserted into between the upper and lower teeth of the plate front end clamp mechanism, which makes it possible to further simplify the positioning operation of the plate front end 80*a*.

Figure 26:
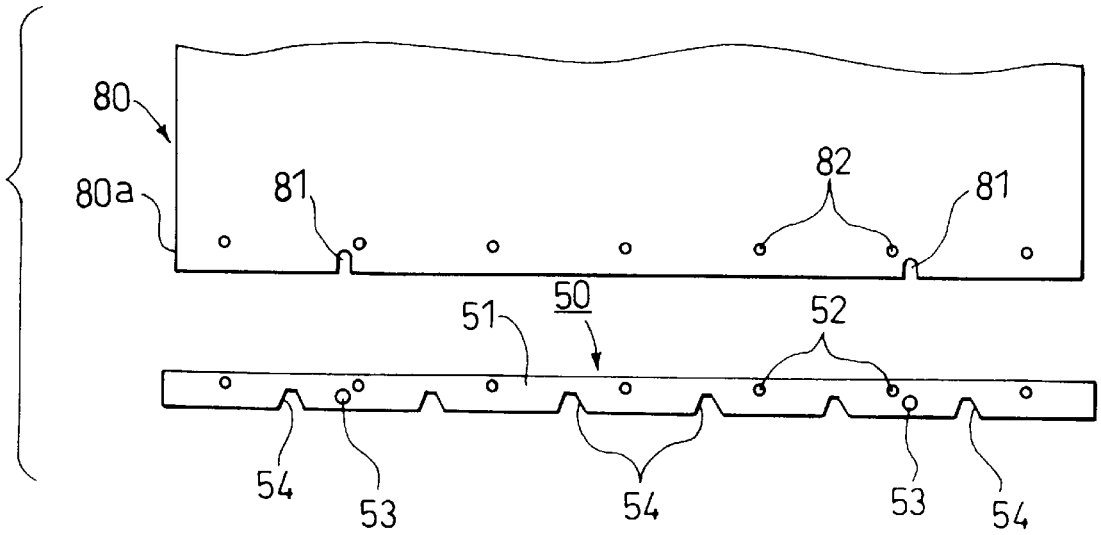
FIG. 26 is a plan view of embodiment 1-3 of the plate-mounting member according to the invention.

Now, FIG. 26 shows a plate-mounting member 50, which provides embodiment 1-3 according to the invention, and a printing plate 80. The plate-mounting member 50 includes a base 51 having a length equal to or greater than the width of the printing plate 80. In the portions of the base 51 that respectively correspond to the two positioning pins 64 of the plate cylinder 61 shown in FIG. 20, there are formed circular-shaped insertion holes 53. Also, on the base 51, there are projectingly provided a plurality of (in this embodiment, 7) fixing pins 52 in such a manner that they are spaced from one another by a given distance in the longitudinal direction of the base 51. Further, in the long side of the base 51 which is opposite to the side thereof where the fixing pins 52 are projectingly provided, more specifically, in the portions of such long side that are to be held by the upper and lower teeth of the plate front end clamp mechanism, there are formed a plurality of (in this embodiment, 6) deformation preventive notches 54 at regular intervals. In this embodiment, each of the deformation preventive notches 54 is formed in a trapezoidal shape when it is viewed from above.

In the above-structured plate-mounting member 50, when the base 51 is held by and between the upper and lower teeth of the plate front end clamp mechanism, even in case where the base 51 is thereby crushed, the deformation preventive notches 54 are appropriately deformed in shape so as to be able to prevent the whole of the plate-mounting member 50 from being deformed. That is, the deformation of the whole of the plate-mounting member 50 can be absorbed by the deformation of the deformation preventive notches 54. Therefore, the durability of the plate-mounting member 50 can be enhanced.

As has been described in detail heretofore, with use of the plate-mounting member according to the first aspect of the invention, not only the mountability of the flexible plate onto the plate cylinder can be enhanced remarkably to thereby reduce the burden of the operator, but also the above-mentioned mismatching can be prevented to thereby allow the flexible plate to be used in a multicolor printing as well.

Next, the second aspect of the present invention is described in more detail below.

The term "the maximum printing length in the plate cylinder rotation direction during the printing plate-mounting operation" means the maximum length that can be printed on paper; and, in the specification and instruction manual of a printing machine, as such maximum printing length, there is set forth a concrete numeric value. Generally, this length can be regarded as the length of the area of the plate cylinder on the diameter circumference thereof that extends from the neighboring portion of the top portion of the plate front end to the neighboring portion of the top portion of the plate rear end.

As the pressure member, there can be employed a roller-shaped pressure member which can be driven by a driving member so as to be contacted with or separated from the plate cylinder. Also, there may also be used a flat-surface pressure member such as a pad-shaped, brush-shaped, or flat-surface-shaped pressure member, which can be driven by a driving member so as to be contacted with or separated from the plate cylinder.

As the positioning pin, there can be employed a pin which is provided on and projected from the upper surface of the lower tooth of the plate front end clamp mechanism toward the upper tooth of the plate front end clamp mechanism, a pin which is provided on and projected from the lower surface of the upper surface toward the lower tooth, or a pin which is provided integrally with the plate cylinder.

As the plate rear end fixing mechanism, there can be used a plate rear end clamp mechanism which includes an upper tooth and a lower tooth. Also, there can also be employed a plate rear end hold mechanism using a plate-spring-shaped member, or means for attaching the plate rear end to the plate cylinder surface or a plate rear end clamp member using a double adhesive tape or spray glue.

According to the above-described items (2-1) and (2-7) of the invention, since the flexible printing plate is contacted with three or more positioning pins and is thereby positioned, the distance between the positioning pins in the plate cylinder is narrow, which can eliminate the possibility that the printing plate can be deformed in such a manner that the plate front end can be projected from between the positioning pins. Also, when winding the printing plate onto the plate cylinder, the pressure member presses the printing plate against the entire outer peripheral surface of the plate cylinder including the top portions thereof to thereby bring the printing plate into close contact with the plate cylinder outer peripheral surface. This eliminates the need to wind the printing plate onto the plate cylinder while pulling the plate rear end thereof; that is, a tensile force is not applied to the printing plate positively, so that the printing plate is little stretched. Therefore, even when the stretching of the printing plate due to the resistance of the pressure member in the printing plate-mounting operation is taken into consideration, the stretching of the printing plate in the maximum printing length can be controlled down to 100 $\mu$m or less.

Further, since the packing sheet, which is capable of preventing the printing plate from deviating in position after it is wound around and fixed to the plate cylinder, supports the wound printing plate strongly, normally, in case where the tensile force of the printing plate is zero or small, the printing plate can be prevented from deviating in position due to a frictional force produced between the printing plate and rubber cylinder during printing.

Therefore, the dimensional stability of the printing plate in the printing plate-mounting operation as well as in the printing operation can be enhanced remarkably, which makes it possible to obtain multicolor printing matching accuracy equivalent to that of a metal support member printing plate. Further, the mountability of the flexible printing plate onto the plate cylinder can be enhanced greatly, so that the burden of the operator can be relieved.

Needless to say, in the conventional plate-mounting method, it is impossible to realize the subject matter of the present invention that the stretching of the printing plate in the maximum printing length in the plate cylinder rotation direction in the flexible printing plate-mounting operation can be controlled down to 100 $\mu$m or less. The first reason for this is that, as described above, when winding the printing plate onto the plate cylinder by rotating the plate cylinder while pulling the plate rear end of the printing plate strongly in order to prevent the printing plate from being floated up from the plate cylinder, the printing plate is easily stretched 100 $\mu$m or more. The second reason is that, since the above-mentioned tensile force apply mechanism is designed according to the printing plate using a support member formed of metal such as aluminum, in the case of the flexible printing plate, it is easily stretched 100 $\mu$m or more. Also, in case where the tensile force apply mechanism is so designed according to the flexible printing plate as to apply such a low tensile force that can control the stretching of the printing plate down to 100 $\mu$m or less, the printing plate cannot be closely contacted with the plate cylinder due to shortage of the tensile force. Even in case where the printing plate can be mounted onto the plate cylinder in such a manner that it is prevented from being floated up from the plate cylinder, with such low tensile force, the printing plate can deviate in position due to a frictional force produced between the rubber cylinder and printing plate in the printing operation.

To control the stretching of the printing plate in the maximum printing length in the plate cylinder rotation direction in the flexible printing plate-mounting operation down to 100 $\mu$m or less, in the case of the flexible printing plate, can be attained regardless of the material, size (length, width, thickness) of the flexible printing plate. This is because the flexible printing plate-mounting method according to the invention is a mounting method which does not apply a tensile force to the flexible printing plate positively.

According to the structures employed in the above-described items (2-2), (2-3), (2-8) and (2-9) of the invention, the plate front end of the printing plate can be protected by the high-rigidity pin contact member including at least three fixing pins and thus the deformation of the plate front end can be prevented. Therefore, without increasing the number of positioning pins used, these structures can be relatively easily applied to an existing printing apparatus and an existing plate making apparatus as well. As the material of the pin contact member having higher rigidity than the printing plate, there can be selected metal. However, the material of the pin contact member is not limited to metal specifically.

According to the structures employed in the above-described items (2-4), (2-5), (2-10) and (2-11) of the invention, the plate base material supports the printing plate wound on the plate base material with a high frictional force or a high sticky force. This can eliminate the possibility that the printing plate can deviate in position due to a frictional force produced between the rubber cylinder and printing plate during printing after the printing plate is mounted onto the plate cylinder.

According to the structures employed in the above-described items (2-6) and (2-12) of the invention, by setting the printing plate in the guide member, there can be avoided the possibility that the flexible printing plate can hang down from the plate cylinder due to the low rigidity of the flexible printing plate. This eliminated the need to hold the printing plate by hand, which can in turn simplify the printing plate-mounting operation.

Also, due to the above, there is also eliminated the need to pull the plate rear end strongly, which can contribute effectively toward controlling the stretching of the printing plate.

According to the structure employed in the above-described item (2-13) of the invention, the operator need not execute the rotation and stopping of the plate cylinder as well as the contact and separation of the pressure member with respect to the plate cylinder which have been conventionally necessary when mounting the printing plate onto the plate cylinder. Therefore, not only the burden of the operator can be further relieved but also the flexible printing plate can be mounted onto the plate cylinder quickly.

In JP-A-10-24555 (The term "JP-A" as used herein means an "unexamined published Japanese patent application"), there are disclosed method and apparatus for positioning and fixing the plate front end of a flexible printing plate using three or more reference pins. The fixing method and apparatus employ a mechanism in which three or more reference pins are disposed on the upper surface of an upper tooth thereof and the reference pins are fitted into reference holes formed in a printing plate to thereby position and fix the printing plate. On the other hand, according to the invention, the reference pins are present between the upper and lower teeth of the plate front end clamp mechanism and are used for contact of the printing plate or pin contact member; and, the plate front end is fixed using the plate front end clamp mechanism. Therefore, the fixing method and apparatus disclosed in the above-cited publication are different from the invention in the structure of the apparatus as well as in the function of the reference pins. Also, in the above-cited publication, there is not disclosed the technological idea of the invention that the flexible printing plate is wound onto the plate cylinder while it is pressed against the entire outer peripheral surface of the plate cylinder using the pressure member.

Also, in the registered Japanese utility model publication 3014242, there is disclosed a flexible printing plate-mounting apparatus including a plate hold roller which is used to press a flexible printing plate against a plate cylinder. However, in this publication, there is not disclosed the technological idea of the invention that, in order to prevent the deformation of the plate front end of the flexible printing plate, the plate front end is contacted with three or more positioning pins, or, the plate front end of the printing plate is fixed to the pin contact member having higher rigidity than the printing plate and the pin contact member is then contacted with the positioning pins.

A plate rear end clamp mechanism employed in the printing plate-mounting apparatus disclosed in the above-cited registered utility model publication is structured such that it firstly holds the printing plate and, after then, it pulls the printing plate. That is, in this plate rear end clamp mechanism, there is not disclosed the technological idea of the invention that a tensile force is not applied to the printing plate positively.

Now, description will be given below in detail of preferred embodiments of the second aspect according to the invention with reference to the accompanying drawings. The parts thereof, which have been already discussed herein with reference to the conventional methods and apparatus, are given the same or corresponding designations and thus the description thereof is simplified or omitted here.

Figure 2:
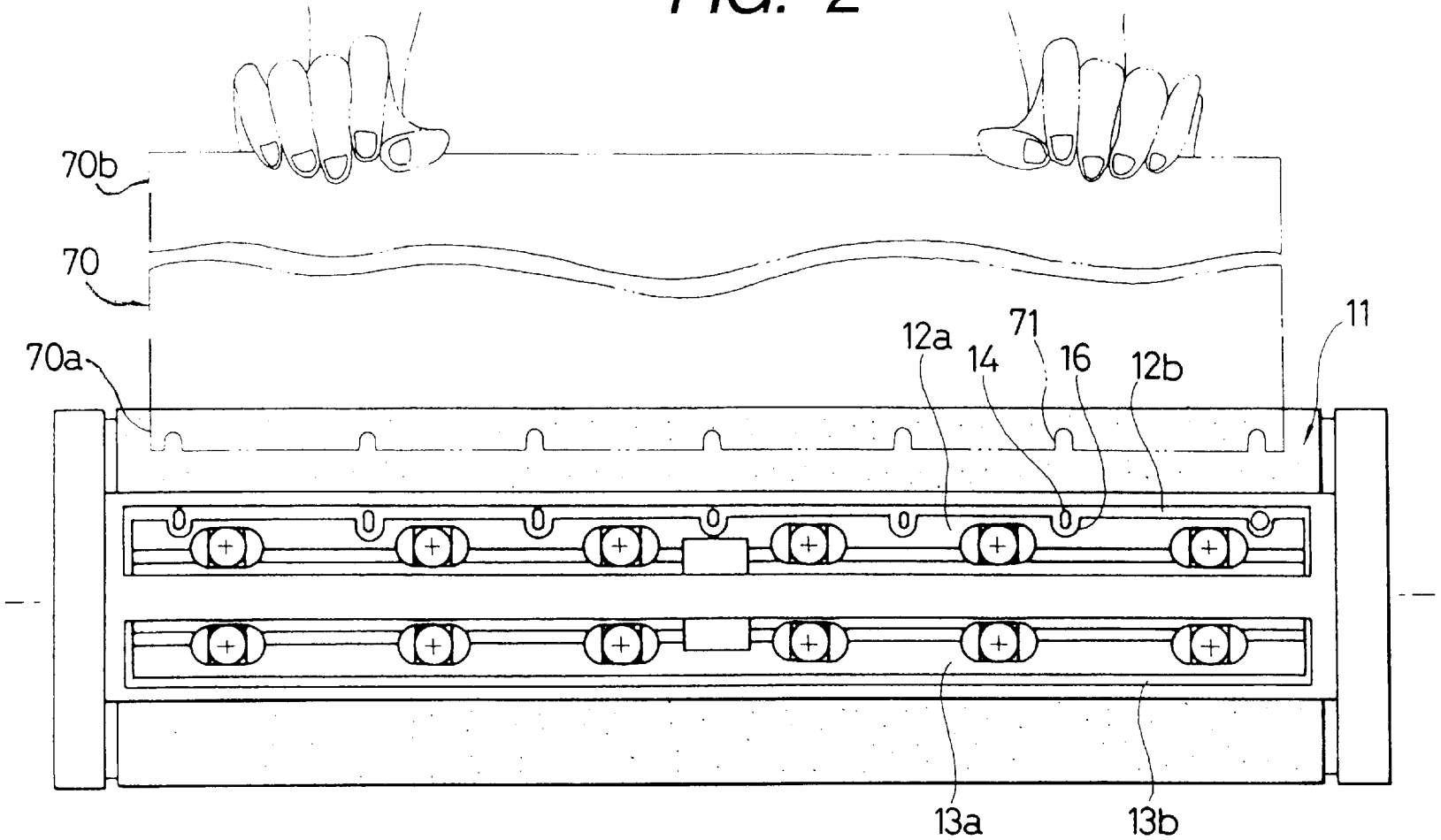
FIG. 2 is a view taken from the direction of the arrow mark X shown in FIG. 1.

FIG. 1 shows embodiment 2-1 of the flexible printing plate-mounting apparatus according to the invention. Specifically, FIG. 1 shows a flexible printing plate-mounting apparatus 10 which is used to mount a flexible (polyester-made) printing plate 70 onto a plate cylinder 11 provided in a printing apparatus for a multicolor printing (four-color printing). FIG. 2 is a view of the apparatus 10 taken from the direction of the arrow mark X shown in FIG. 1, showing the plate cylinder 11 according to the present embodiment.

As shown in FIG. 1, the flexible printing plate-mounting apparatus 10 comprises a plate cylinder 11 including a plate front end clamp mechanism 12 and a plate rear end clamp mechanism 13; a hold roller 17 and a rubber cylinder 25 which can be respectively contacted with and separated from the outer peripheral surface of the plate cylinder 11; and, guide member 20 which is used to guide the plate front end of the flexible printing plate 70 to the plate front end clamp mechanism 12. Here, the plate cylinder 11 can be rotated and stopped by a rotation controller (not shown). Also, the controller includes a member of detecting the rotational position of the plate cylinder 11.

The guide member 20 is structured by disposing a guide roller 23 on the leading end of each of an appropriate number (in the illustrated embodiment, 2) of support members 22 respectively provided on and projected from a plate-shaped member 21. Here, as the plate-shaped member 21, there is used a cover which covers the side surface of a printing apparatus 500.

The rubber cylinder 25 is structured such that it can be contacted with and separated from the plate cylinder 11 and thus, when winding the printing plate 70 onto the plate cylinder 11, the printing plate 70 can also be held and pressed by and between the plate cylinder 11 and this rubber cylinder 25. On the contact portion between the plate cylinder 11 and rubber cylinder 25, specifically, on the side (in FIG. 1, on the left side) of such contact portion where the printing plate 70 can be inserted, there is disposed a hand cover 26 having a substantially L-shaped section; and, the hand cover 26 can prevent an operator from having his or her finger caught in error by and between the rubber cylinder 25 and plate cylinder 11.

Figure 3:
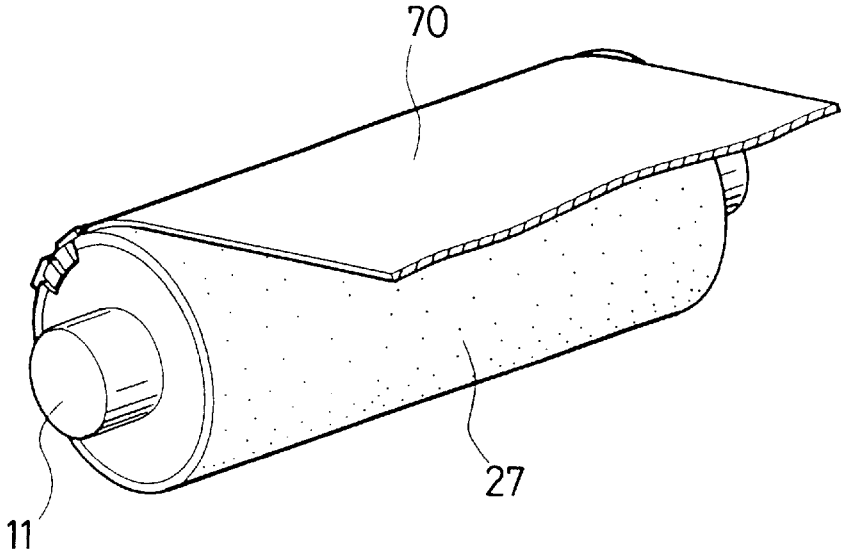
FIG. 3 is a view of a plate base material wound around a plate cylinder according to embodiment 2-1.

On the plate cylinder 11, as shown in FIG. 3, there is wound and fixed a plate base material 27 (a material forming the base part of the plate cylinder 11) at least one surface of which is formed as a roughened surface in such a manner that the roughened surface becomes an outer surface side thereof. As a sheet-shaped base material used as the plate base material 27, there can be employed plastics such as polyethylene terephthalate, polypropylene and polyethylene; or, metal such as aluminum and SUS; or, paper or synthetic paper; or, cloth. That is, any material can be used, provided that it can be well fitted with the plate cylinder 11 of the printing apparatus.

Figure 4:
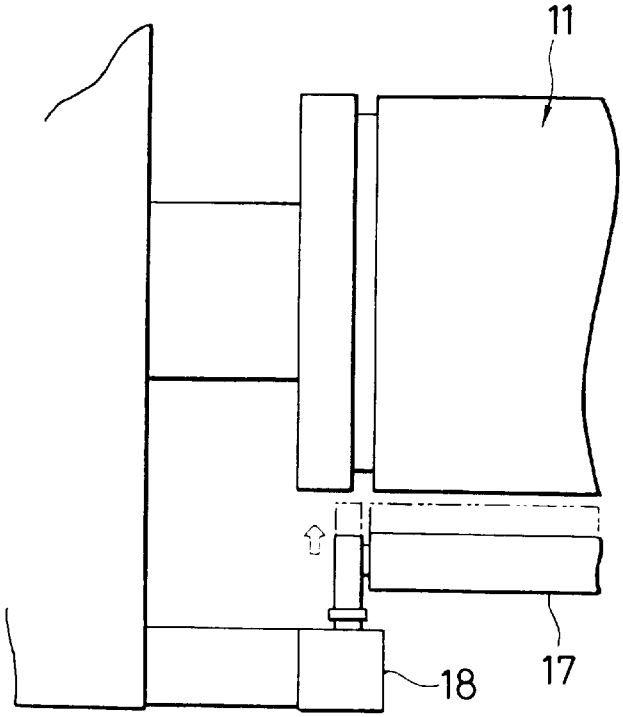
FIG. 4 is a view of a hold roller employed in embodiment 2-1.

The hold roller 17, as shown in FIG. 4, is assembled to an appropriate driving member such as a cylinder 18 and is structured such that it can be contacted with or separated from the outer peripheral surface of the plate cylinder 11 by a driving member controller (not shown). Here, in order not to damage the flexible printing plate 70, the hold roller 17 may be preferably formed of elastic material such as rubber.

And, as shown in FIG. 2, on the upper surface of the lower tooth 12*b* of the plate front end clamp mechanism 12, there are projectingly provided three or more (in this embodiment, 7) positioning pins 14 in such a manner that they are spaced by a given distance from one another in the axial direction of the plate cylinder 11. Here, of the seven positioning pins 14, only one positioning pin 14 shown on the right in FIG. 2 has a circular section, whereas the other remaining positioning pins 14 are respectively so formed as to have such a section shape that can be obtained by cutting away the two sides of a circle in a direction to cross at right angles to the axial direction of the plate cylinder 11, in order that the widths of these positioning pins 14 in the axial direction of the plate cylinder 11 are narrower than the width of the positioning pin 14 having the above-mentioned circular section shape in the axial direction of the plate cylinder 11.

Also, not only in the appropriate portions of the upper tooth 12*a* that respectively correspond to the positions of the positioning pins 14, but also in the appropriate portions of the plate front end 70*a* of the printing plate 70, there are formed notches 16, 71, respectively.

When mounting the printing plate 70 onto the thus-structured plate cylinder 11, the operator firstly sets the printing plate 70 on the guide member 20, pushes the printing plate 70 in such a manner that the plate front end 70*a* is inserted into between the upper tooth 12*a* and lower tooth 12*b* of the plate front end clamp mechanism 12, and brings the inner peripheral surfaces of the notches 71 of the plate front end 70*a* into contact with the positioning pins 14 shown in FIG. 2 to thereby position the plate front end 70*a*. In this state, the upper tooth 12*a* is closed to thereby fix the plate front end 70*a*.

Next, in the state shown in FIG. 1, the plate cylinder 11 is rotated counterclockwise using the rotation controller (not shown) to thereby wind the printing plate 70 onto the plate cylinder 11, including curved surface portion 11*b*. During the rotational movement of the plate cylinder 11, at the time when the controller detects the rotational position of the plate cylinder 11 where the hold roller 17 can be contacted with the flat surface portion 11*a* of the plate cylinder 11, the controller stops the rotational movement of the plate cylinder 11.

Figure 5:
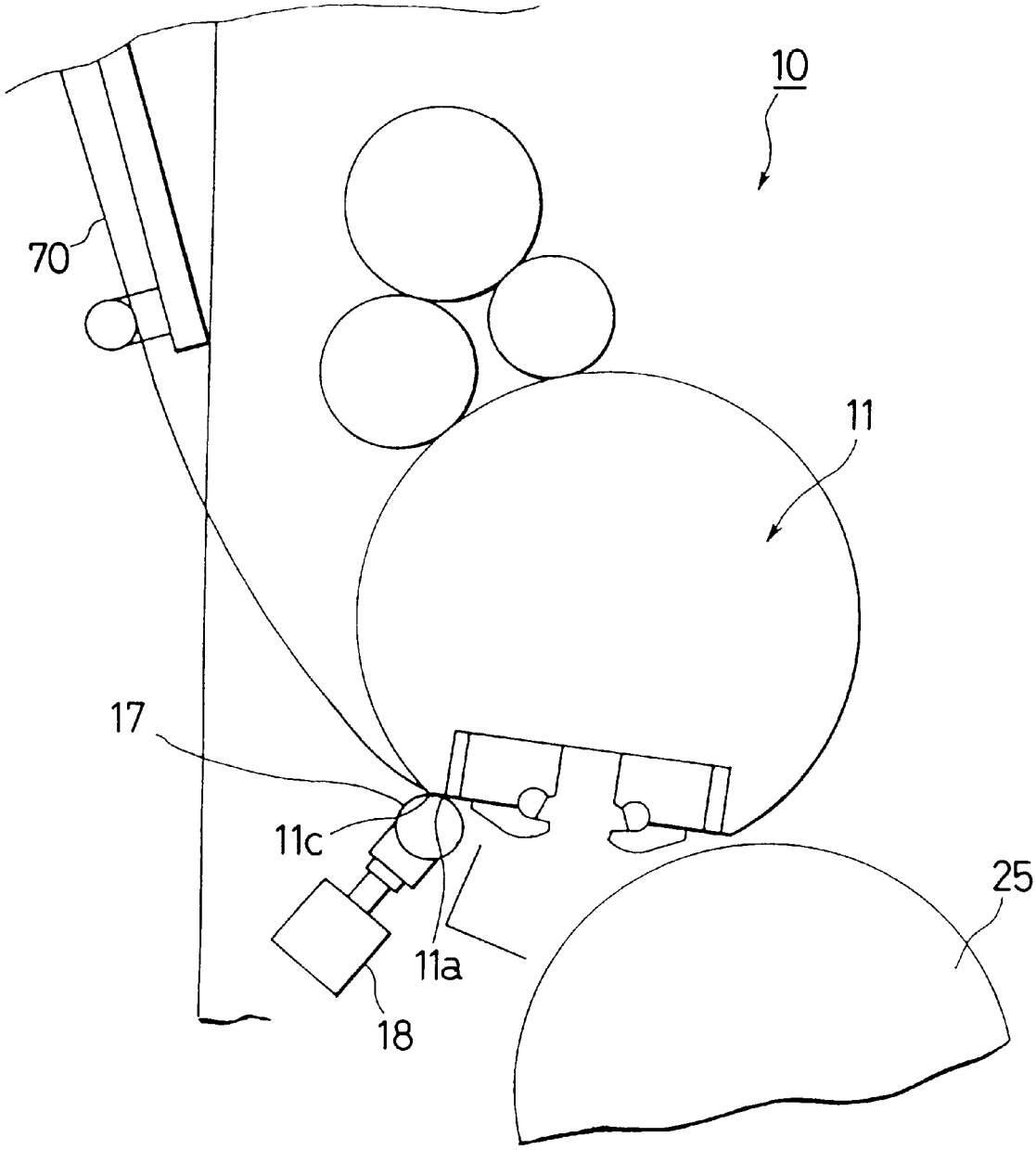
FIG. 5 shows how to mount a flexible printing plate according to embodiment 2-1.

And, as shown in FIG. 5, the hold roller 17 is contacted with the flat surface portion 11*a* of the plate cylinder 11 and the printing plate 70 is pressed against the outer peripheral surface of the plate cylinder 11. Then, the plate cylinder 11 is rotated again counterclockwise using the rotation controller (not shown). In this manner, the hold roller 17 can be so operated as to press the printing plate 70 against the outer peripheral surface of the plate cylinder 11 before and behind the top portions 11*c* of the plate cylinder 11. At the then time, the hold roller 17, which is energized by the cylinder 18 toward the outer peripheral surface of the plate cylinder 11, is allowed to advance and retreat according to the shape of the outer peripheral surface of the plate cylinder 11.

Figure 6:
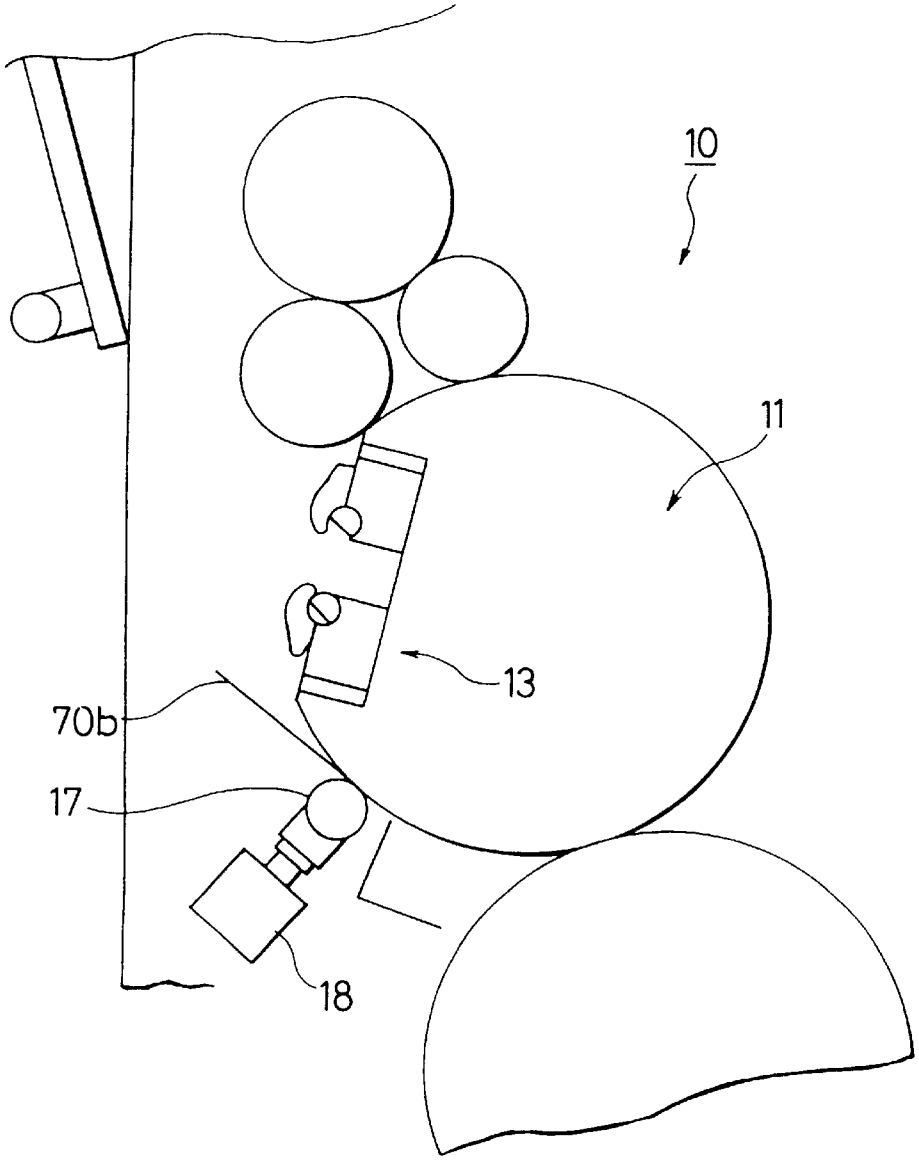
FIG. 6 also shows how to mount a flexible printing plate according to embodiment 2-1.

The plate cylinder 11 is rotated on and, as shown in FIG. 6, at the time when the printing plate 70 is wound on the plate cylinder 11 up to the neighboring portion of the plate rear end clamp mechanism 13, the rotation controller (not shown) stops the rotational movement of the plate cylinder 11.

Figure 7:
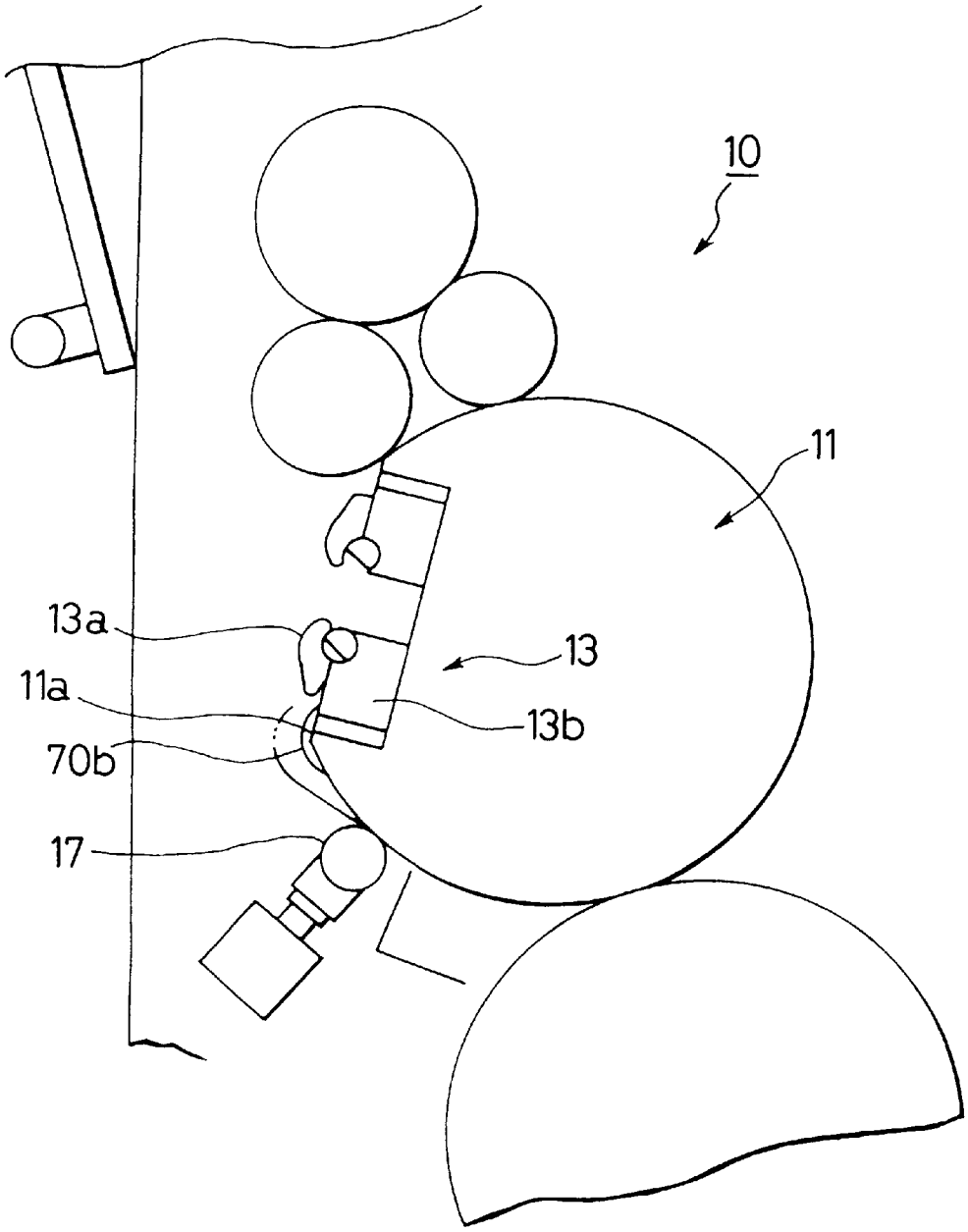
FIG. 7 also shows how to mount a flexible printing plate according to embodiment 2-1.
Figure 8:
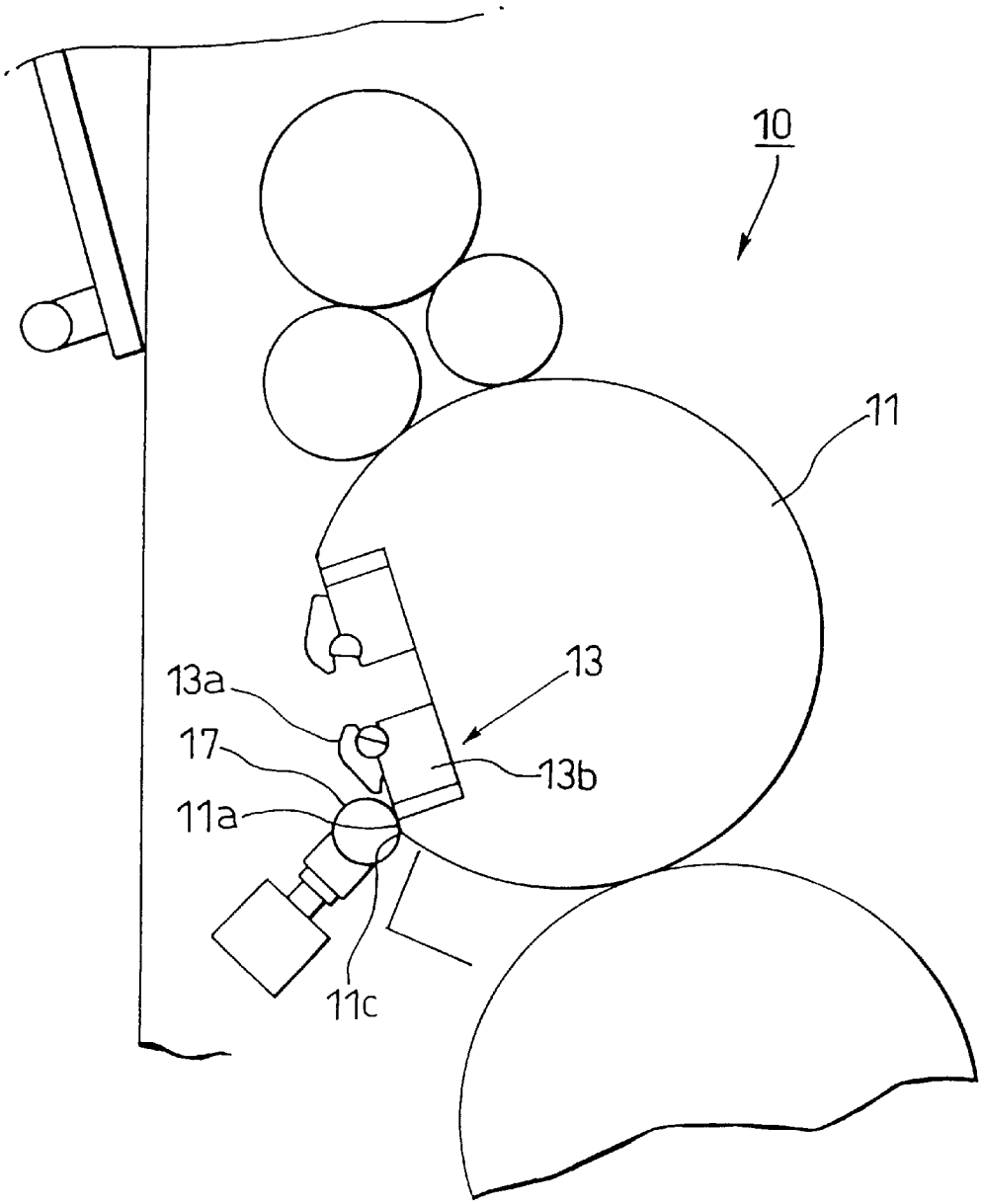
FIG. 8 also shows how to mount a flexible printing plate according to embodiment 2-1.

At the then time, the operator, as shown in FIG. 7, curves the neighboring portion of the plate rear end of the printing plate 70 to thereby insert the plate rear end 70*b* into between the upper tooth 13*a* and lower tooth 13*b* of the plate rear end clamp mechanism 13. In this state, the plate rear end 70*b* is floated up from the flat surface portion 11*a* of the plate cylinder 11 and the upper surface of the lower tooth 13*b*. And, the plate cylinder 11 is rotated counterclockwise again using the rotation controller (not shown). In this manner, the hold roller 17 can be so operated as to press the printing plate 70 against the outer peripheral surface of the plate cylinder 11 before and behind the top portions 11*c* of the plate cylinder 11; and, at the same time, as shown in FIG. 8, the plate rear end can be closely contacted with the flat surface portion 11*a* of the plate cylinder 11 and the upper surface of the lower tooth 13*b*.

Finally, after the upper tooth 13*a* of the plate rear end clamp mechanism 13 is closed to thereby fix the plate rear end, the hold roller 17 is retreated from the printing plate 70 using the rotation controller (not shown), thereby completing the mounting operation of the flexible printing plate onto the plate cylinder 11.

In the above-structured flexible printing plate-mounting apparatus 10, the plate front end 70*a* of the flexible printing plate 70 is contacted with the seven positioning pins 14 which are respectively provided on and projected from the lower tooth 12*b* of the plate front end clamp mechanism, thereby positioning the plate front end 70*a*. Therefore, the distance between the positioning pins 14 in the plate cylinder is narrow when compared with the distance provided in the conventional printing plate-mounting apparatus; and thus, even in the case of a printing plate of a large size such as a half-kiku size, there is eliminated a fear that the flexible printing plate 70 can be deformed in such a manner that the plate front end 70*a* is projected from between the positioning pins 14.

And, in the flexible printing plate-mounting apparatus 10, since the hold roller 17 presses the flexible printing plate 70 against the top portions (the top portion on the plate front end clamp mechanism 12 side and the top portion on the plate rear end clamp mechanism 13 side) 11*c* of the outer peripheral surface of the plate cylinder 11 including the portions before and behind the top portions of the outer peripheral surface of the plate cylinder 11, there is no fear that the flexible printing plate 70 wound around the plate cylinder 11 can be floated up from the outer peripheral surface of the plate cylinder 11. Therefore, there is no need for the operator to pull the plate rear end 70*b* strongly, which can prevent the plate rear end 70*b* against deformation such as stretch. Also, the burden of the operator in the flexible printing plate-mounting operation can be relieved.

In the present embodiment, when fixing the plate rear end 70*b* to the plate rear end clamp mechanism 13, the operator curves the neighboring portion of the plate rear end 70*b* of the flexible printing plate 70 to thereby insert the plate rear end 70*b* into between the upper tooth 13*a* and lower tooth 13*b* of the plate rear end clamp mechanism 13. Thanks to this, the plate rear end clamp mechanism 13 need not be structured such that the upper tooth 13*a* can be opened greatly. That is, the structure of the plate rear end clamp mechanism 13 can be simplified.

Also, since, as the plate-shaped member 21 of the guide member 20, there is used the cover of the printing apparatus 500, the flexible printing plate-mounting apparatus 10 can be reduced in cost and size.

And, of the seven positioning pins 14, the width of only one positioning pin 14 in the axial direction of the plate cylinder 11 is set wider than those of the other remaining positioning pins 14 in the axial direction of the plate cylinder 11. This makes it possible to contact the inner peripheral surfaces of the notches 71 of the flexible printing plate 70 with the positioning pins 14 easily. Also, the flexible printing plate 70 can be positioned accurately by the positioning pin with the plate-cylinder-axial-direction width thereof set wider than those of the other remaining positioning pins 14.

Also, the plate cylinder 11 can be automatically rotated by the controller, the rotational movement of the plate cylinder 11 can be stopped at a given position, and the hold roller 17 can also be automatically contacted with and separated from the plate cylinder 11 by the controller. This can relieve the burden of the operator further.

And, on the plate cylinder 11, there is wound and fixed the plate base material 27 at least one surface of which is formed as a roughened surface in such a manner that the roughened surface becomes an outer surface thereof. Due to this, the deformation and positional deviation of the flexible printing plate 70 after the flexible printing plate 70 is contacted with the outer peripheral surface of the plate cylinder 11 can be prevented positively.

In the present embodiment, when the hold roller 17 is contacted with and separated from the plate cylinder 11, the rotational movement of the plate cylinder 11 is stopped. However, alternatively, by changing the setting of the controller (not shown), the hold roller 17 may be contacted with and separated from the plate cylinder 11 without stopping the rotational movement of the plate cylinder 11.

Figure 19:
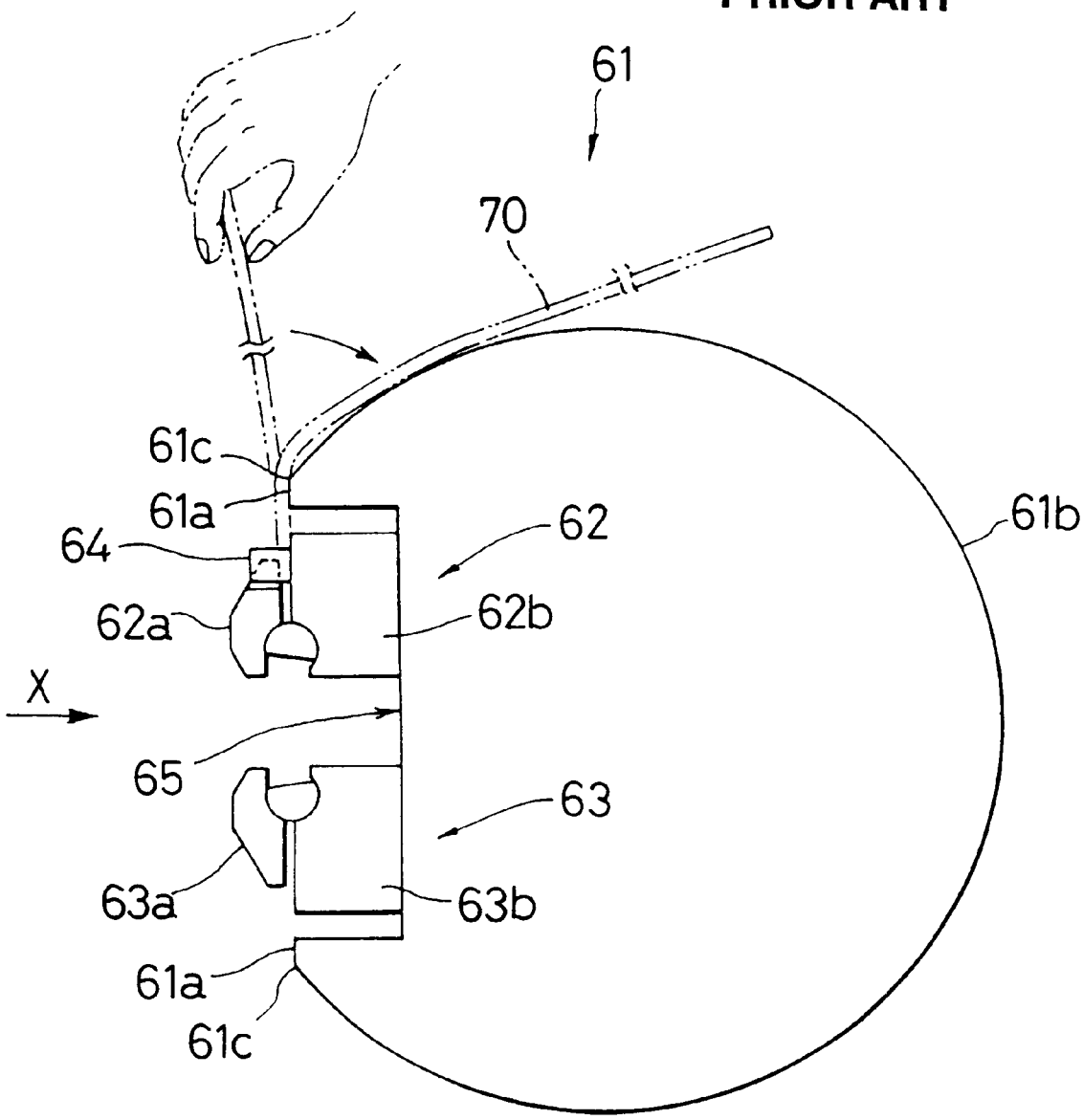
FIG. 19 PRIOR ART
FIG. 19 is a view of a conventional flexible printing plate-mounting apparatus; and, FIG. 20 is a view taken from the direction of the arrow mark X shown in FIG. 19.

Next, description will be given below of embodiment 2-2 of the flexible printing plate-mounting apparatus according to the invention with reference to FIGS. 9 and 10. In the flexible printing plate-mounting apparatus according to embodiment 2-2, as a plate cylinder, there is used a conventional plate cylinder 61 which is shown in FIGS. 19 and 20. And, on the present plate cylinder 61, there is wound and fixed the plate base material 27 (see FIG. 3), which is used in the previously described embodiment 2-1 and at least one surface of which is formed as a roughened surface, in such a manner that the roughened surface becomes an outer surface thereof.

The flexible printing plate-mounting apparatus according to embodiment 2-2 has a similar structure to the flexible printing plate-mounting apparatus 10 (see FIG. 1) according to embodiment 2-1, except for the plate cylinder.

Figure 9:
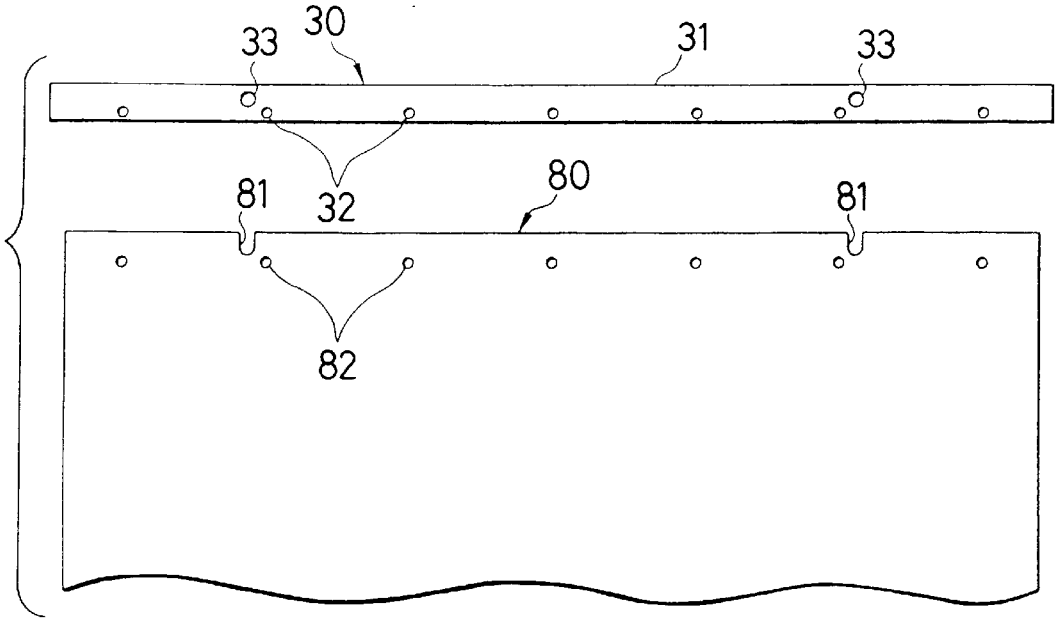
FIG. 9 is a view of a flexible printing plate and a pin contact member employed in embodiment 2-2 of the flexible printing plate-mounting apparatus according to the invention.

In FIG. 9, there are shown a flexible printing plate 80 and a pin contact member 30 to be fixed to the plate front end of the flexible printing plate 80, which are both used in the present embodiment. In the plate front end of the flexible printing plate 80, more specifically, in the portions of the flexible printing plate 80 front end that correspond to two positioning pins 64 shown in FIG. 20, there are formed two notches 81 each having a substantially U-shaped peripheral edge. Also, in the plate front end, there are formed at least three (in this embodiment, 7) fixing holes 82 at appropriate intervals in the width direction (in FIG. 9, in the right and left direction) of the flexible printing plate 80.

The pin contact member 30 includes a band-shaped base 31 which is formed of high-rigidity material such as metal and has a length equal to or greater than the width of the flexible printing plate 80. In the base 31, specifically, in the portions of the base 31 that correspond to the two positioning pins 64 shown in FIG. 20, there are formed two circular-shaped insertion holes 33. Also, the base 31 includes at least three (in this embodiment, 7) fixing pins 32 which are provided on and projected from the base 31 at appropriate intervals in the longitudinal direction of the base 31.

Figure 10A:
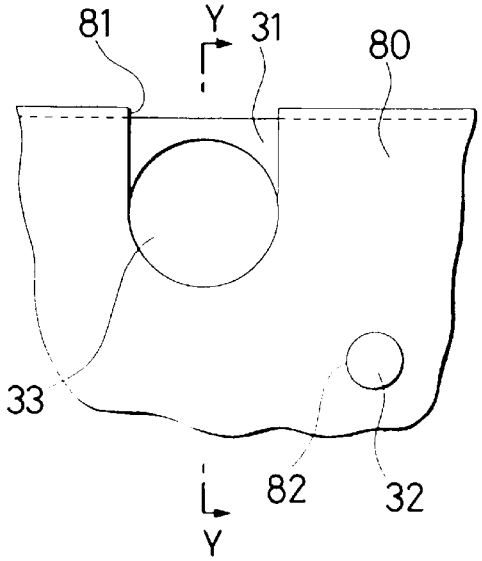
FIGS. 10(A) and 10(B) is a view of the flexible printing plate and pin contact member shown in FIG. 9, showing a state in which the pin contact member is fixed to the flexible printing plate.
Figure 10B:
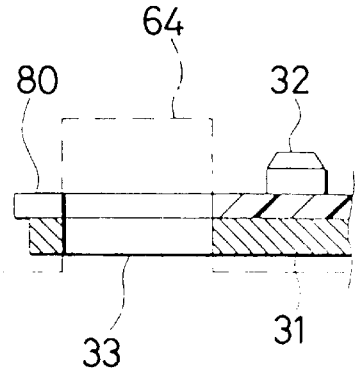

Now, FIG. 10(A) is an enlarged view of the neighboring portion of each notch 81 of the flexible printing plate 80, showing a state thereof when the pin contact member 30 shown in FIG. 9 is fixed to the plate front end of the flexible printing plate 80. Also, FIG. 10(B) is a section view taken along the line Y—Y shown in FIG. 10(A). As shown in FIG. 10(A), by inserting the fixing pin 32 of the pin contact member 30 into its associated fixing hole 82 of the flexible printing plate 80, the pin contact member 30 can be fixed to the flexible printing plate 80. In this case, the pin contact member 30 and flexible printing plate 80 are set such that a portion of the peripheral edge of the circular-shaped insertion hole 33 of the pin contact member 30 coincides with the curved portion of the substantially U-shaped peripheral edge of the notch 81 of the flexible printing plate 80.

When mounting the flexible printing plate 80 onto the plate cylinder 61 shown in FIG. 20, the plate front end of the flexible printing plate 80 may be firstly fixed to the pin contact member 30 and, after then, the plate front end may be fixed to the plate front end clamp mechanism 62; or, with the two positioning pins 64 of the plate front end clamp mechanism 62 inserted into the two insertion holes 33 of the pin contact member 30, the plate front end of the flexible printing plate 80 may be fixed to the pin contact member 30.

As shown by a one-dot chained line in FIG. 10(B), when the two positioning pins 64 of the plate cylinder 61 are respectively inserted into the two insertion holes 33 of the pin contact member 30, the inner peripheral surfaces of the notches 81 of the flexible printing plate 80 are respectively contacted with the two positioning pins 64 together with the inner peripheral surfaces of the two insertion holes 33 of the pin contact member 30.

The operation to wind and mount the flexible printing plate 80 onto the plate cylinder 61 is executed similarly to embodiment 2-1.

In the above-structured flexible printing plate-mounting apparatus, in case where the plate front end of the flexible printing plate 80 is positioned and fixed by the plate front end clamp mechanism, the present plate front end is protected by the high-rigidity pin contact member 30, thereby preventing the plate front end against deformation. Therefore, with use of the pin contact member 30, not only the deformation of the printing plate 80 can be prevented without increasing the number of the positioning pins used, but also it is possible to use the plate cylinder 61 of the existing printing apparatus. In case where the present embodiment is enforced using an existing facility, the facility cost of the present embodiment can be reduced to a great extent.

Next, description will be given below of embodiment 2-3 of the flexible printing plate-mounting apparatus according to the invention with reference to FIGS. 11 and 12. In embodiment 2-3, the pin contact member 30 used in the previously described embodiment 2-2 is changed but the remaining portions of embodiment 2-3 are similar in structure to embodiment 2-2.

Figure 11:
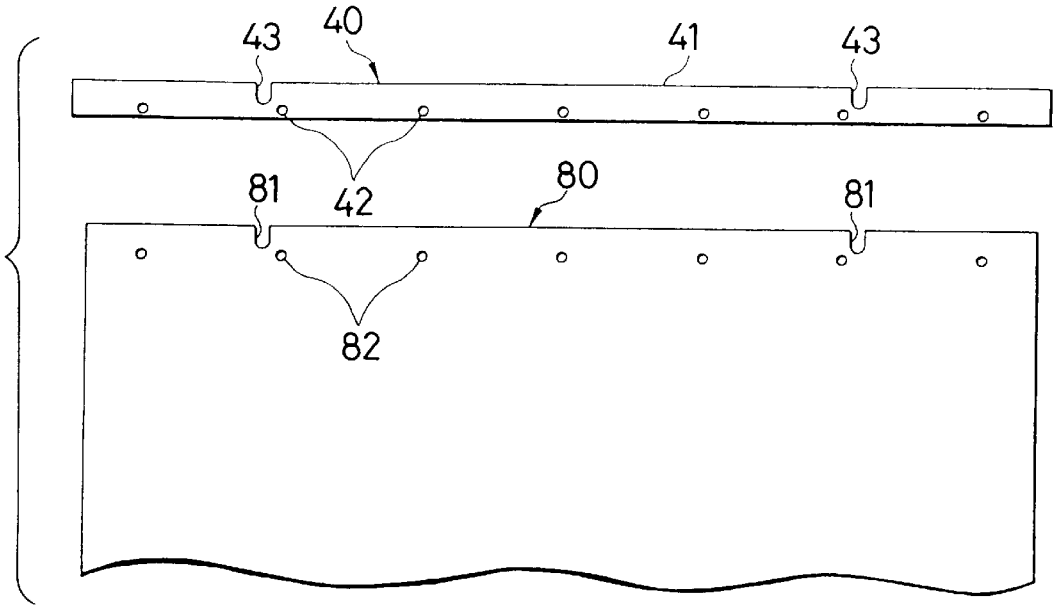
FIG. 11 is a view of a flexible printing plate and a pin contact member employed in embodiment 2-3 of the flexible printing plate-mounting apparatus according to the invention.

FIG. 11 shows parts which are used in the present embodiment; that is, a flexible printing plate 80 and a pin contact member 40 to be fixed to the plate front end of the flexible printing plate 80.

The pin contact member 40 includes a band-shaped base 41 which is formed of high-rigidity material such as metal and has a length equal to or greater than the width of the flexible printing plate 80. In the base 41, specifically, in the portions of the base 41 that correspond to the two positioning pins 64 shown in FIG. 20, there are formed two circular-shaped insertion holes 43. Also, the base 41 includes at least three (in this embodiment, 7) fixing pins 42 which are provided on and projected from the base 31 at appropriate intervals in the longitudinal direction of the base 41.

Figure 12:
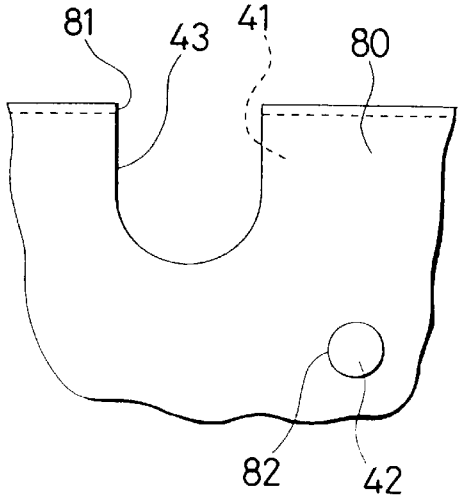
FIG. 12 is a view of the flexible printing plate and pin contact member shown in FIG. 11, showing a state in which the pin contact member is fixed to the flexible printing plate.

Now, FIG. 12 is an enlarged view of the neighboring portion of each notch 81 of the flexible printing plate 80, showing a state thereof when the pin contact member 40 is fixed to the plate front end of the flexible printing plate 80. As shown in FIG. 12, by inserting the fixing pin 42 of the pin contact member 40 into its associated fixing hole 82 of the flexible printing plate 80, the pin contact member 40 can be fixed to the flexible printing plate 80. In this case, the pin contact member 40 and flexible printing plate 80 are set such that a portion of the peripheral edge of the circular-shaped insertion hole 43 of the pin contact member 40 coincides with the curved portion of the substantially U-shaped peripheral edge of the notch 81 of the flexible printing plate 80.

According to the above-structured flexible printing plate-mounting apparatus, after the pin contact member 40 is fixed to the plate front end of the flexible printing plate 80, when fixing the present plate front end to the plate front end clamp mechanism, the pin contact member 40 can be inserted into between the upper and lower teeth of the plate front end clamp mechanism to thereby position both of the pin contact member 40 and the plate front end of the flexible printing plate 80. This makes it possible to simplify the plate front end positioning and fixing operation further.

Figure 13:
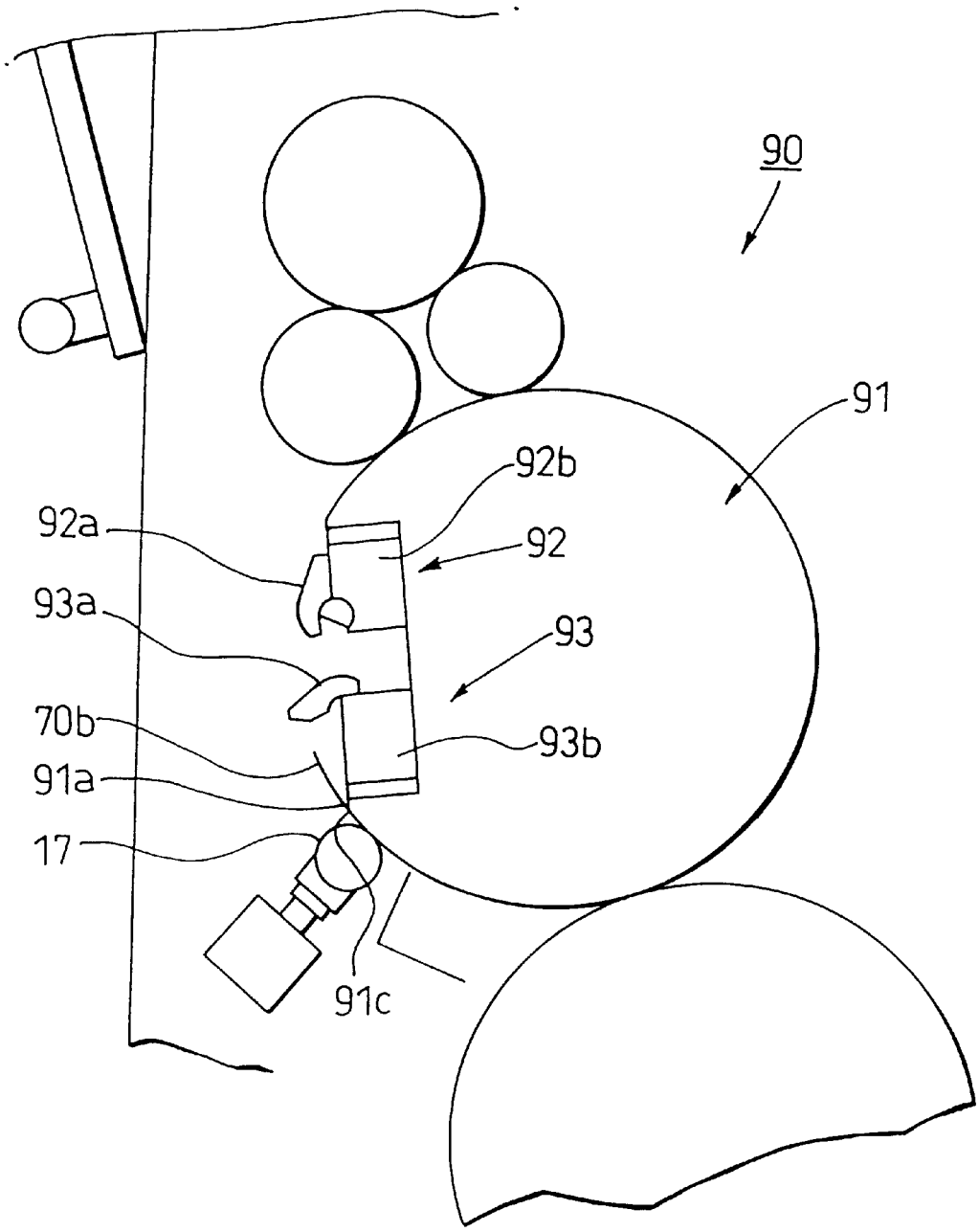
FIG. 13 is a view of embodiment 2-4 of the flexible printing plate-mounting apparatus according to the invention.

Next, FIG. 13 shows embodiment 2-4 of the flexible printing plate-mounting apparatus according to the invention. In the flexible printing plate-mounting apparatus 90 according to embodiment 2-4, the upper tooth 93*a* of a plate rear end clamp mechanism 93 provided in a plate cylinder 91 can be pulled apart greatly from the upper face of the lower tooth 93*b* of the plate rear end clamp mechanism 93: that is, the upper tooth 93*a* can be held in such a manner that it does not cover the upper surface of the lower tooth 93*b*. In embodiment 2-4, the upper tooth 93*a* can be rotated until an angle formed between the lower surface of the upper tooth 93*a* and the upper surface of the lower surface 93*b* becomes equal to or greater than an angle where the plate rear end and the clamp surface of the upper tooth 93*a* are not contacted with each other in a state shown in FIG. 13.

In the present embodiment, on the plate cylinder 91, there is wound and fixed a plate base material at least one surface of which is formed as a sticky surface in such a manner that the sticky surface becomes an outer surface thereof.

The sticky surface can be formed, for example, by spraying a spray adhesive onto a sheet-shaped base body, by bonding two-side adhesive tape to the sheet-shaped base body, or by applying sticky material to the base body.

When mounting the flexible printing plate 70, using a similar process to embodiment 2-1, the plate front end is fixed by a plate front end clamp mechanism 92, including an upper tooth 92*a* and a lower tooth 92*b*, and the flexible printing plate 70 is wound around the outer peripheral surface of the plate cylinder 91. And, as shown in FIG. 13, at the time when the flexible printing plate 70 is wound around the plate cylinder 91 up to the neighboring portion of the plate rear end clamp mechanism 93, the upper tooth 93*a* of the plate rear end clamp mechanism 93 is opened wide to thereby set the upper tooth 93*a* in a state in which it does not cover the upper surface of the lower tooth 93*b*.

And, as shown in FIG. 13, a hold roller 17 is contacted with the curved surface portion of the plate cylinder 91 to thereby press the flexible printing plate 70 against the outer peripheral surface of the plate cylinder 91 and, in this state, the plate cylinder 91 is rotated counterclockwise. In this case, due to the operation of the hold roller 17, the flexible printing plate 70 can be pressed against the outer peripheral surface of the plate cylinder 91 before and behind the top portions 91*c* of the plate cylinder 91 and, at the same time, the plate rear end 70*b* of the flexible printing plate 70 can be closely contacted with the flat surface portion 91*a* of the plate cylinder 91 and the upper surface of the lower tooth 93*b*.

Finally, after the upper tooth 93*a* of the plate rear end clamp mechanism is closed to thereby fix the plate rear end 70*b*, the hold roller 17 is retreated from the flexible printing plate 70, which completes the mounting of the flexible printing plate 70 onto the plate cylinder 91.

In the above-structured flexible printing plate-mounting apparatus 90, since there is eliminated the need that the plate rear end 70*b* of the flexible printing plate 70 is curved and is thereby inserted into between the upper tooth 93*a* and lower tooth 93*b* of the plate rear end clamp mechanism 93, the flexible printing plate-mounting operation can be simplified further and the-thus simplified operation is suitable for automation as well.

Figure 14:
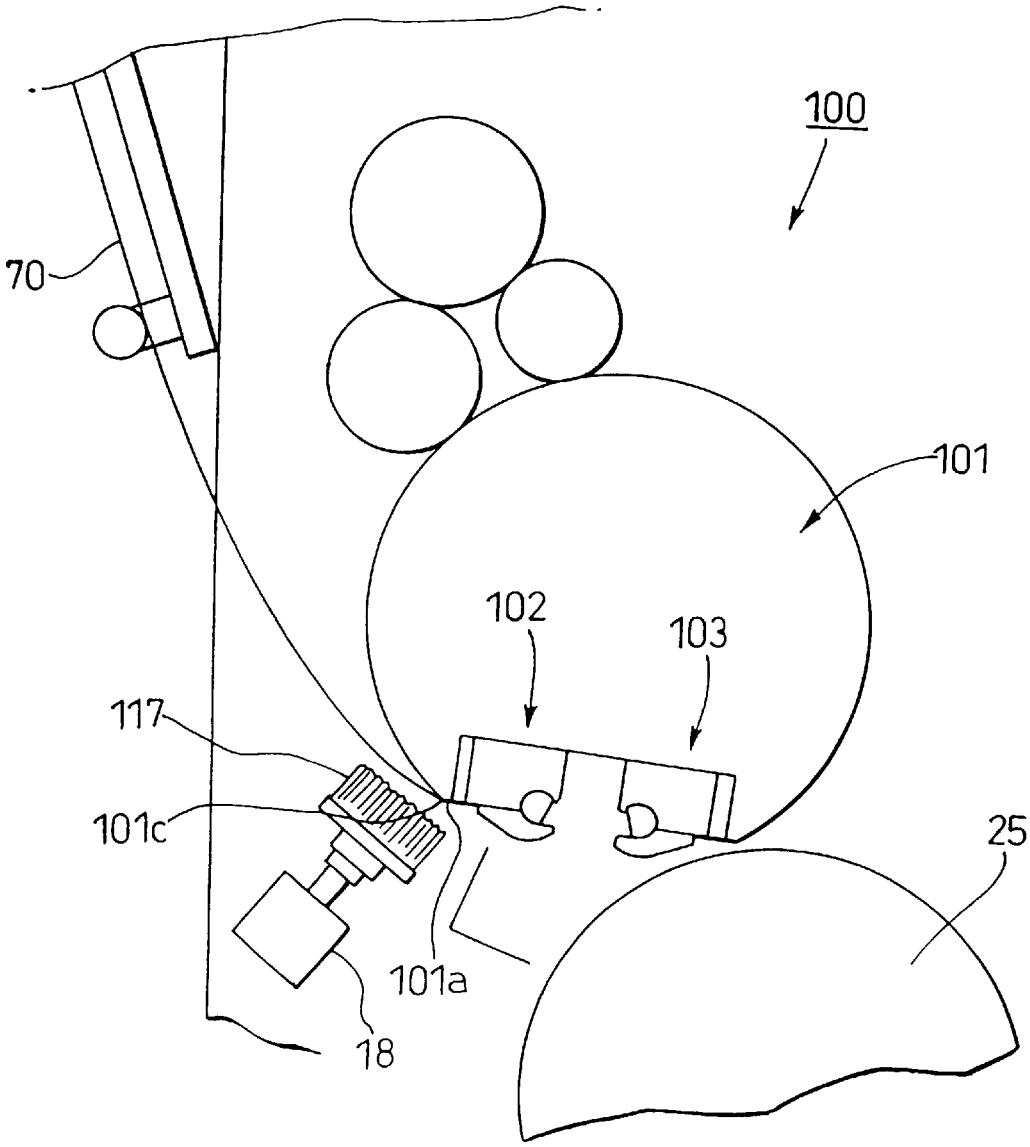
FIG. 14 is a view of embodiment 2-5 of the flexible printing plate-mounting apparatus according to the invention.

Now, FIG. 14 shows embodiment 2-5 of the flexible printing plate-mounting apparatus according to the invention. In the flexible printing plate-mounting apparatus 100 according to embodiment 2-5, as the pressure member which is used to press a flexible printing plate 70 against the outer peripheral surface of the plate cylinder 91 at least before and behind the top portions of a plate cylinder 101 (including flat surface portions 101*a*, top portions 101*c*, a plate front end clamp mechanism 102, and a plate rear end clamp mechanism 103), there is employed a flat surface pressure member. Here, the flat surface pressure member is structured such that a brush 117, the leading end portions of which are substantially the same in height so as to form a single flat surface, can be driven by an air cylinder 18 to thereby contact the brush 117 with the plate cylinder 101 and separate the brush 117 from the plate cylinder 101.

As the brush 117, there can be employed a brush formed of chemical synthetic fiber such as nylon, polypropylene, vinyl chloride, PBT and aramide; a brush formed of plant fiber (palm); or, a brush formed of animal fiber (pig fur, horsehair, sheep fur).

The operation to wind the flexible printing plate 70 onto the plate cylinder 101 is carried out in a similar manner to embodiment 2-1. However, in the present embodiment, since the flexible printing plate 70 can be pressed against the outer peripheral surface of the plate cylinder 101 over a wide range by the flat surface pressure member, in a process for winding the flexible printing plate 70, the accuracy of the timing for stopping the rotation of the plate cylinder 101 may be set low.

In the above-structured flexible printing plate-mounting apparatus 100, since the flexible printing plate 70 can be pressed against the outer peripheral surface of the plate cylinder 101 over a wide range by the flat surface pressure member, the floating of the flexible printing plate 70 from the outer peripheral surface of the plate cylinder 101 can be prevented positively and easily. For example, while rotating and stopping the plate cylinder 101 by hand, the flexible printing plate 70 can be mounted onto the plate cylinder 101.

In the present embodiment, the brush is structured such that the leading end portions thereof can be so arranged to form a flat surface. However, the leading end portions of the brush may also be so arranged as to form a plurality of flat surfaces, provided that the brush can press the flexible printing plate 70 against the outer peripheral surface of the plate cylinder 101; for example, the leading end portions of the brush may be arranged such that the section of the brush leading end face is formed as a V shape.

Also, in the present embodiment, the flat surface pressure member is structured by using the brush. However, instead of the brush, there can be used a pad which is formed of sponge (urethane sponge, cellulose sponge) or felt. And, it is also possible to use a pad in which core material such as sponge, felt or rubber is covered with molten (cloth).

Figure 15:
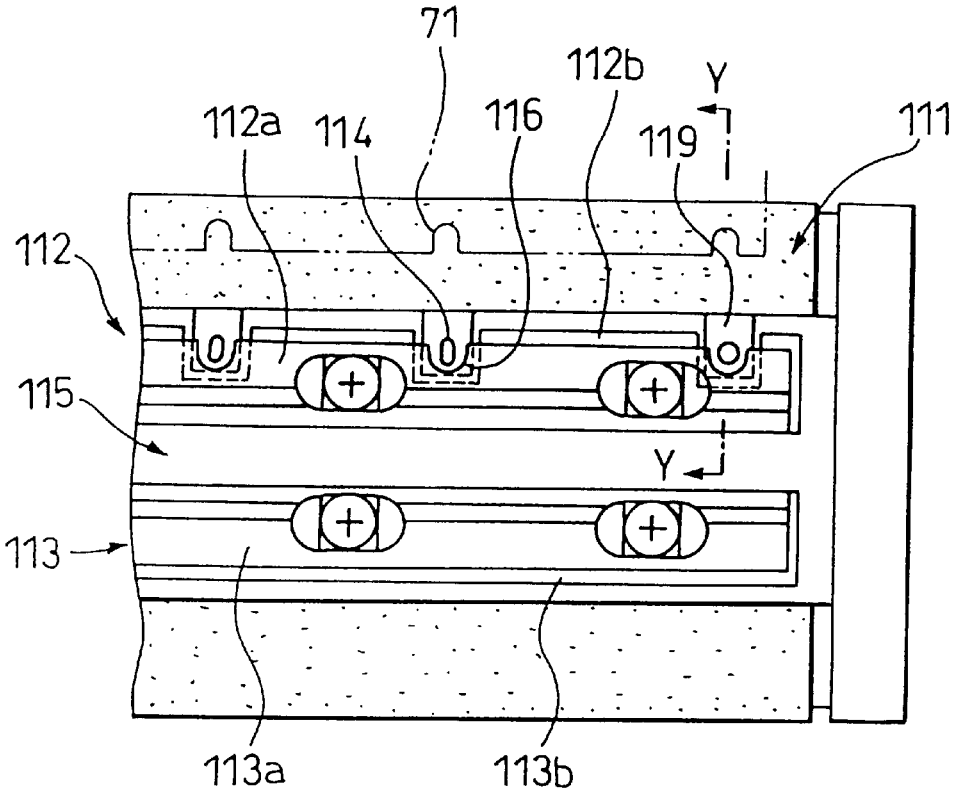
FIG. 15 is a partially enlarged view of a plate cylinder used in embodiment 2-6 of the flexible printing plate-mounting apparatus according to the invention.

Next, description will be given below of embodiment 2-6 of the flexible printing plate-mounting apparatus according to the invention with reference to FIGS. 15 and 16. FIG. 15 is a partially enlarged view of a plate cylinder 111 according to the present embodiment. Within a groove portion 115 formed in the plate cylinder 111, there are disposed a plate front end clamp mechanism 112 (including an upper tooth 112*a* and a lower tooth 112*b*) and a plate rear end clamp mechanism 113 (including an upper tooth 113*a* and a lower tooth 113*b*). In the lower tooth 112*b* of the plate front end clamp mechanism 112, there are formed notches each having a rectangular shape when it is viewed from above, in such a manner that they are spaced from each other at a given interval in the axial direction of the plate cylinder 111; and, in each notch, there is disposed a pin block 119 which is formed integral with the plate cylinder 111. And, a positioning pin 114 is provided on and projected from the pin block 119, and is accommodated by notch 116.

Figure 16:
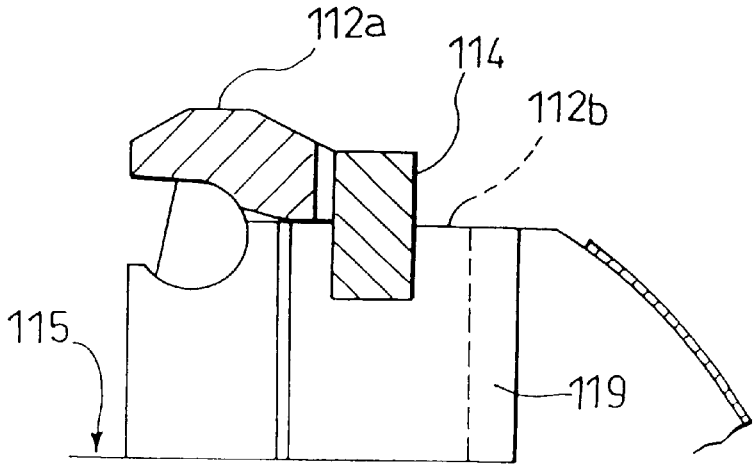
FIG. 16 is a section view taken along the line Y—Y shown in FIG. 15.

As shown in FIG. 16 which is a section view taken along the line Y—Y shown in FIG. 15, one side surface of the pin block 119 is closely contacted with the side surface of the groove portion 115.

In the above-structured flexible printing plate-mounting apparatus, the positioning pin 114 is formed integral with the plate cylinder 111 through the pin block 119. Due to this, the plate front end portion can be positioned with more accuracy.

Figure 17:
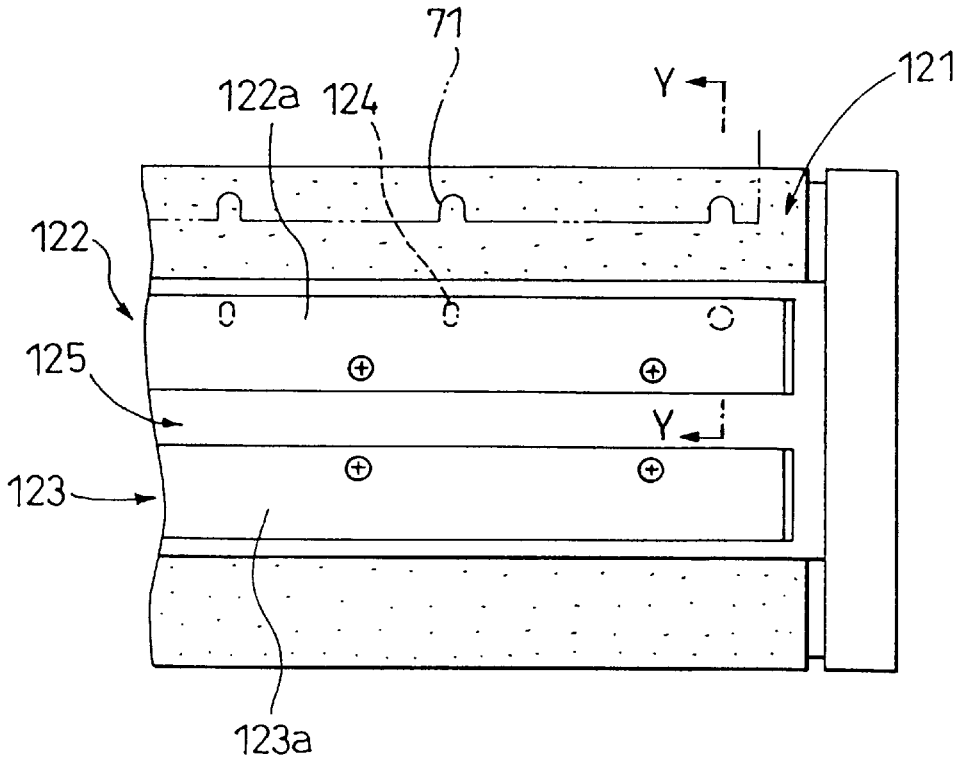
FIG. 17 is a partially enlarged view of a plate cylinder used in embodiment 2-7 of the flexible printing plate-mounting apparatus according to the invention.

Next, description will be given below of embodiment 2-7 of the flexible printing plate-mounting apparatus according to the invention with reference to FIGS. 17 and 18. Here, FIG. 17 is a partially enlarged view of a plate cylinder 121 according to embodiment 2-7. Within a groove portion 125 formed in the plate cylinder 121, there are disposed a plate front end clamp mechanism 122 and a plate rear end clamp mechanism 123. The clamp mechanisms 122 and 123 respectively include plate-shaped upper teeth 122*a* and 123*a*. In the present embodiment, the upper teeth 122*a* and 123*a* are respectively fixed within the groove portion 125. And, on the lower surface of the upper tooth 122*a* of the plate front end clamp mechanism 122, there are projectingly provided positioning pins 124 at given intervals in the axial direction of the plate cylinder 121.

Figure 18:
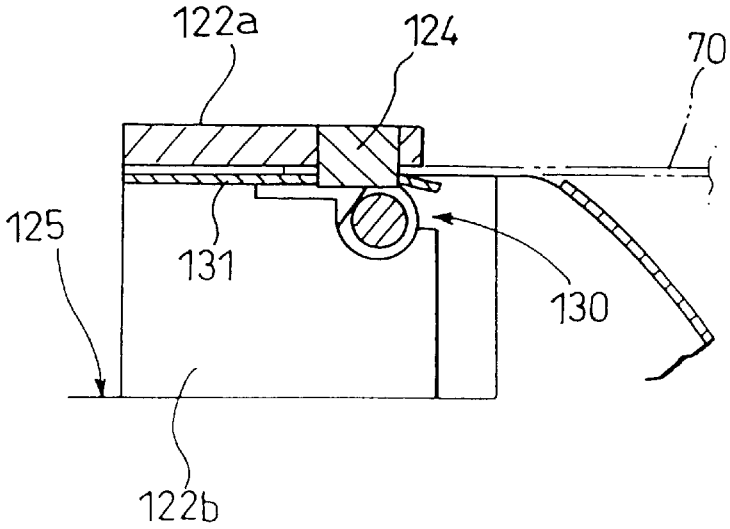
FIG. 18 is a section view taken along the line Y—Y shown in FIG. 17.

Now, FIG. 18 is a section view taken along the line Y—Y shown in FIG. 17. On the upper portion of a lower tooth 122*b* disposed on the bottom surface of the groove portion 125, there is disposed a shaft-shaped cam member 130 the diameter of which is reduced at the portions that correspond to the positioning pins 124 hanging from the upper tooth 122*a*. And, between the cam member 130 and upper tooth 122*a,* there is interposed a plate spring 131. By rotating the cam member 130, the upper tooth 122*a* and plate spring 131 can opened and closed with respect to each other, which makes it possible to hold the plate front end of the flexible printing plate 70. That is, in the present embodiment, the plate spring 131 substantially functions as a lower tooth for holding the plate front end between the upper tooth 122*a* and itself.

In the above-structured flexible printing plate-mounting apparatus, the positioning pins 124 are disposed on the upper tooth 122*a* in such a manner that they extend toward the lower tooth 122*b;* and thus, the upper tooth 122*a* is not movable. Therefore, a hold roller can be made to approach very closely to the upper tooth 122*a,* so that the flexible printing plate 70 can be closely contacted with the plate cylinder 121 more positively.

As has been described heretofore, according to the mounting method and apparatus of the invention for mounting a flexible printing plate, especially, a digitally-made flexible printing plate, the dimensional stability of the flexible printing plate in the flexible printing plate-mounting operation and printing operation can be enhanced remarkably, thereby being able to obtain multicolor printing matching accuracy equivalent to that of a metal support member printing plate. Also, the mountability of the flexible printing plate onto a plate cylinder can also be enhanced greatly, which makes it possible to reduce the burden of an operator. Further, since the invention can also be enforced simply by improving an existing printing machine to a slight degree, the facility cost of the invention can be saved.

While the present invention has been described in detail and with reference to specific embodiments thereof, it will be apparent to one skilled in the art that various changes and modifications can be made therein without departing from the spirit and scope thereof.

What is claimed is:

1. A plate-mounting member to be attached to a plate front end of a flexible plate in order to mount said flexible plate having a plurality of fixing holes onto a plate cylinder including a plate front end clamp mechanism having upper and lower teeth and at least two positioning pins disposed between upper and lower teeth, said plate-mounting member comprising a base and a plurality of fixing pins disposed on said base to be respectively inserted into said plurality of fixing holes formed in said plate front end, wherein said base is to be attached to said positioning pins disposed in said plate front end clamp mechanism to thereby position said plate front end, wherein deformation preventative notches are formed in the portions of said base that are to be held by said upper and lower teeth.

2. The plate-mounting member according to claim 1, further comprising means for mounting the plate-mounting member to a plate cylinder, wherein said means for mounting is disposed on said base.

3. The plate-mounting member according to claim 1, wherein said base and said fixing pins are configured and arranged so that when said base is clamped by said plate front end clamp mechanism, said flexible plate is also clamped by said plate front end clamp mechanism.

4. The plate-mounting member according to claim 1, wherein the plate is positioned by notches upon mounting onto the plate cylinder.

5. The plate-mounting member according to claim 1, wherein said plurality of fixing pins are disposed on said base along the width direction of said plate and the distance between adjacent fixing pins is not more than 400 mm.

* * * * *